US007215903B2

(12) United States Patent
Suzuki

(10) Patent No.: US 7,215,903 B2
(45) Date of Patent: May 8, 2007

(54) CARTRIDGE AND METHOD FOR FILLING A CONSUMABLE INTO THE CARTRIDGE

(75) Inventor: Tsutomu Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 67 days.

(21) Appl. No.: 10/876,578

(22) Filed: Jun. 28, 2004

(65) Prior Publication Data

US 2005/0002684 A1 Jan. 6, 2005

(30) Foreign Application Priority Data

Jul. 1, 2003 (JP) ..... 2003-189208
Jul. 9, 2003 (JP) ..... 2003-194523

(51) Int. Cl.
*G03G 15/00* (2006.01)

(52) U.S. Cl. ..... 399/109; 399/111; 399/119; 399/120

(58) Field of Classification Search ..... 399/109, 399/111, 119, 120, 262, 263; 222/DIG. 1
See application file for complete search history.

(56) References Cited

U.S. PATENT DOCUMENTS 4,992,802 A 2/1991 Dion et al.
5,499,082 A 3/1996 Watanabe et al.
5,884,130 A 3/1999 Tsutsumi et al.
5,974,288 A * 10/1999 Sato ..... 399/119
6,038,416 A 3/2000 Okano et al.
6,164,769 A 12/2000 Inada et al.
6,625,413 B2 * 9/2003 Oguma et al. ..... 399/222

FOREIGN PATENT DOCUMENTS

| | | |
|---|---|---|
| DE | 44 34 162 A1 | 4/1996 |
| EP | 0 116 466 A2 | 8/1984 |
| EP | 0 778 504 A1 | 6/1997 |
| JP | A-58-57152 | 4/1983 |
| JP | A-7-28374 | 1/1995 |
| JP | A 9-190135 | 7/1997 |
| JP | A 10-115974 | 5/1998 |
| JP | A 11-305529 | 11/1999 |
| JP | A 2001-122361 | 5/2001 |
| JP | A 2001-331025 | 11/2001 |
| JP | A 2002-251119 | 9/2002 |
| JP | A-2002-331793 | 11/2002 |
| WO | WO 94/11194 | 5/1994 |

* cited by examiner

*Primary Examiner*—Hoang Ngo
(74) *Attorney, Agent, or Firm*—Oliff & Berridge, PLC

(57) ABSTRACT

A cartridge includes a case that accommodates a consumable therein, a land area that protrudes from a surface of the case, and a recess that is formed on a reverse side of the surface at a position corresponding to the land area, a reverse side of a deepest portion of the recess being the land area, wherein the deepest portion of the recess is toward the land area with respect to the surface.

23 Claims, 20 Drawing Sheets

CARTRIDGE AND METHOD FOR FILLING A CONSUMABLE INTO THE CARTRIDGE

CROSS-REFERENCE TO RELATED APPLICATION

This application claims priority from JP 2003-194523, filed Jul. 9, 2003 and JP 2003-189208, filed Jul. 1, 2003, the disclosures of which are incorporated in their entirety herein by reference thereto.

BACKGROUND OF THE INVENTION

1. Field of Invention

The invention relates to a cartridge that is exchangeably mounted on image forming apparatuses, such as printers, facsimile machines, and copiers and that fills thereinto a consumable such as toner and ink.

2. Description of Related Art

In recent years, a cartridge filled with toner as a developing medium has been used for printers, facsimile machines, and copiers. A certain amount of toner is filled into the cartridge at the time of production. The cartridge is exchangeably set in, for example, a printer. As the toner in the cartridge is used and the remaining amount of the toner is reduced, the printing quality begins to fade. The cartridge thus needs to be replaced. At this time, the cartridge may also be replenished with the toner so that the cartridge can be reused.

A method for reusing a cartridge is disclosed in, for example, paragraphs 0029 to 0031, as well as FIG. 4 of Japanese Laid-Open Patent Publication No. 2001-122361. First, a toner filling port is formed in a part of a top of the used cartridge using a tool such as a drill and a driver. Then, toner is filled through the toner filling port into the cartridge. The toner filling port is then sealed with tape. Thus, reuse of the cartridge leads to cost reductions, as well as resource savings.

The cartridge into which the toner is filled is provided with an agitator that agitates the toner in the cartridge. The agitator is rotatably disposed in the cartridge with a shaft of the agitator supported in a case of the cartridge. For example, U.S. Pat. No. 5,884,130 discloses a structure that supports a shaft of an agitator using-bearings protruding from a case.

As shown in FIG. 25, a substantially V-shaped groove 202 is formed on an inner wall 201 of a case 207. With an agitator shaft 204 disposed in a deepest portion 203 of the groove 202, the groove 202 fits therein a substantially inverted trapezoidal side plate 205 provided with an upper cover 206, which is separately provided from the case 207. The shaft 204 is fixedly sandwiched between a bottom surface of the deepest portion 203 and a lower end of the side plate 205.

SUMMARY OF THE INVENTION

As the toner filling port is formed using a tool on the top of the cartridge, the tool may contact components such as the agitator provided in the cartridge thus leading to damage to the components. When the agitator is damaged, the cartridge cannot be used again. Supporting the shaft of the agitator with bearings protruding from the case also leads to increases in the production costs.

In the apparatus shown in FIG. 25, the shaft 204 is disposed between the bottom surface of the deepest portion 203 and the lower end of the side plate 205 with some clearance due to deviations or tolerances created while connecting the upper cover 206 to the case 207 using ultrasonic welding. Accordingly, the looseness of the shaft 204 in the vertical direction occurs so that the agitator cannot be properly rotated.

Accordingly, one exemplary aspect of the invention provides for a cartridge in which a port for filling a consumable is readily formed on the cartridge when the cartridge is reused.

A cartridge according to a first exemplary aspect of the invention may include a case that accommodates a consumable therein, a land area that protrudes from a surface of the case, and a recess that is formed on a reverse side of the surface at a position corresponding to the land area, a reverse side of a deepest portion of the recess being the land area, wherein the deepest portion of the recess is toward the land area with respect to the surface.

A method according to an exemplary aspect of the invention for filling a consumable into a cartridge including a case that accommodates a consumable therein, a land area that protrudes from a surface of the case, and a recess that is formed on a reverse side of the surface at a position corresponding to the land area, a reverse side of a deepest portion of the recess being the land area, and the deepest portion of the recess being toward the land area with respect to the predetermined surface, comprising forming a port at a position corresponding to the recess by cutting off the land area, filling the consumable through the port, and covering the port with a label member.

A cartridge according to another exemplary aspect of the invention may include a case that accommodates a consumable therein, a port that is formed on a surface of the case, a flat area that protrudes from the surface of the case and is formed around the port, wherein a recess is formed at an area corresponding to a reverse side of the flat area, and a label member attached to the flat area to cover the port.

Another exemplary aspect of the invention is to properly rotate an agitator that agitates a developing agent by supporting a shaft of the agitator accurately.

A developing cartridge according to another exemplary aspect of the invention may include a developing agent containing chamber that contains a developing agent, an agitator provided in the developing agent containing chamber, and a shaft supporting portion that supports at least one end of a shaft of the agitator, the shaft supporting portion including a recessed groove that is formed on an inner wall of the developing agent containing chamber and is open on an upper end side thereof, the shaft being supported at a deepest portion of the recessed groove, and a restricting portion that restricts a vertical movement of the shaft supported at the deepest portion of the recessed groove, the restricting portion being integrally formed with the recessed groove.

BRIEF DESCRIPTION OF THE DRAWINGS

Embodiments of the invention will be described with reference to the accompanying drawings in which like elements are labeled with like numbers and in which.

DETAILED DESCRIPTION OF PREFERRED EMBODIMENTS

Figure 1:
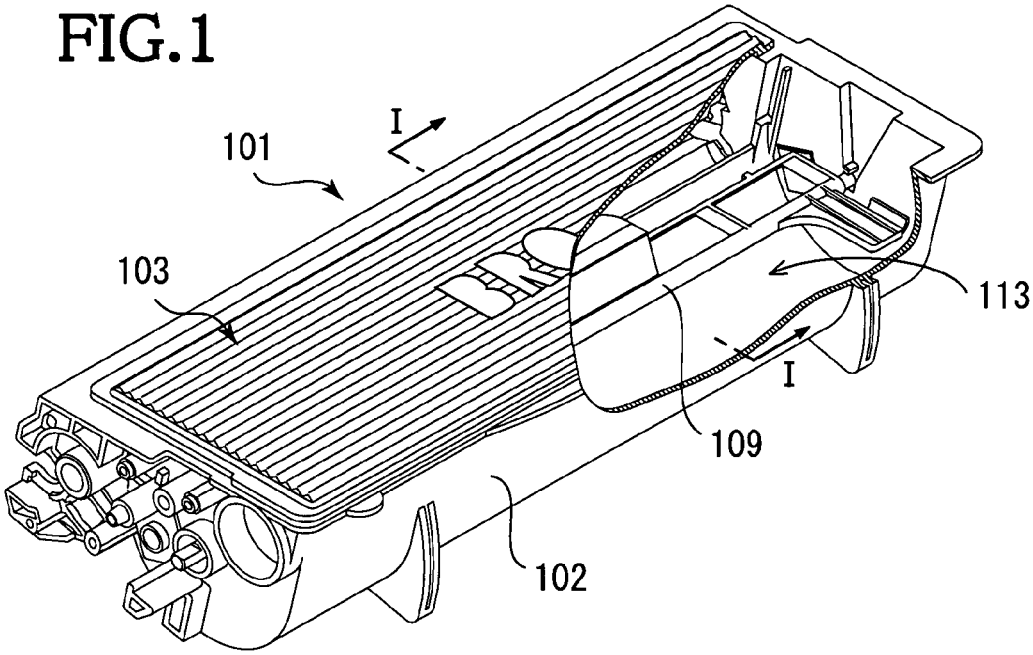
FIG. 1 is a perspective view of a cartridge according to a first embodiment of the invention.

FIG. 1 shows a replaceable cartridge 101 according to a first embodiment of the invention. A case of the cartridge 101 is formed of a plastic material, such as ABS (acrylonitrile butadiene styrene), into a box shape. The cartridge 101 includes a cartridge body 102 of a box shape that is open upwardly and a top 103 that covers the opening of the cartridge body 102. The cartridge body 102 and the top 103 are connected by ultrasonic welding.

Figure 2:
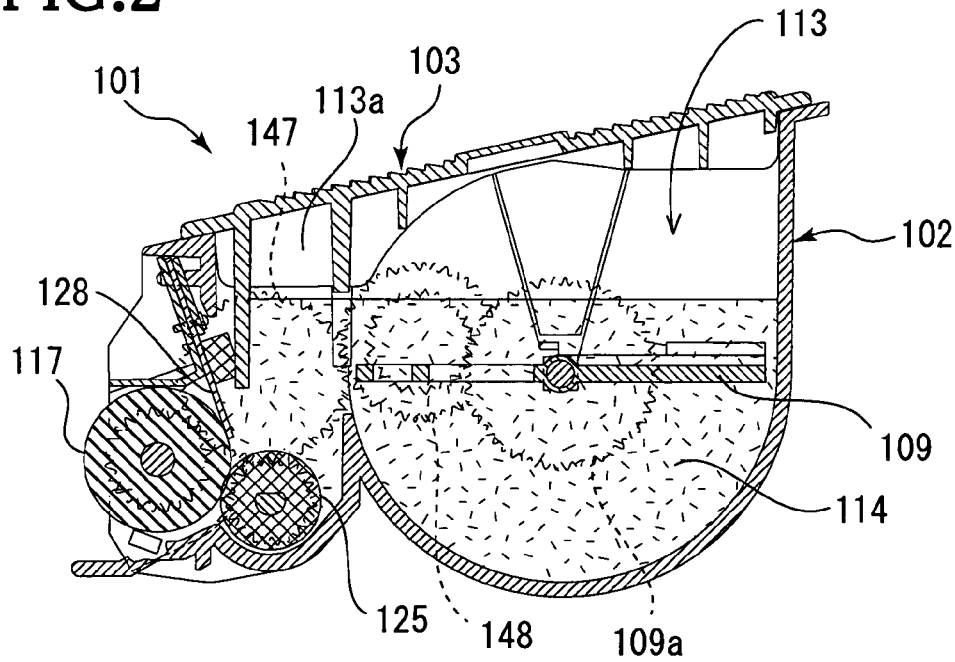
FIG. 2 is a sectional view of the cartridge, taken along line I—I of FIG. 1.

As shown in FIG. 2, provided in an inner space of the cartridge 101 are a toner reservoir 113 and a toner supply portion 113*a* disposed adjacent to the toner reservoir 113. Toner 114, as a consumable, is filled into the toner reservoir 113 and the toner supply portion 113*a*.

Disposed in the toner supply portion 113*a* are a developing roller 117 that carries thereon the toner 114, a supply roller 125 that supplies the toner 114 to the developing roller 117, and a blade 128 that regulates the thickness of the toner layer carried on a surface of the developing roller 117. The developing roller 117 may constantly carry a certain amount of the toner 114 on an outer surface thereof and the toner 114 in the cartridge 101 may be efficiently used. Disposed in the toner reservoir 113 is an agitator 109 that agitates the toner 114 in the toner reservoir 113. Even when the toner 114 is used and the amount of the toner 114 remaining in the cartridge 101 is reduced, the toner 114 may be agitated by driving the agitator 109. Accordingly, the toner 114 may be supplied to the developing roller 117. Thus, the toner 114 remaining in the cartridge 101 may be efficiently used, which serves to save resources. Even when the toner 114 is unevenly filled into the cartridge 101, the toner 114 may be agitated by the agitator 109. Accordingly, the toner 114 may always be evenly spread in the cartridge 101.

An end of a shaft of the agitator 109 passes through a side wall of the cartridge body 102. An agitator gear 109*a* is mounted on the end of the shaft of the agitator 109. The agitator gear 109*a* is engaged with a gear 148, which engages with another gear 147.

Figure 3:
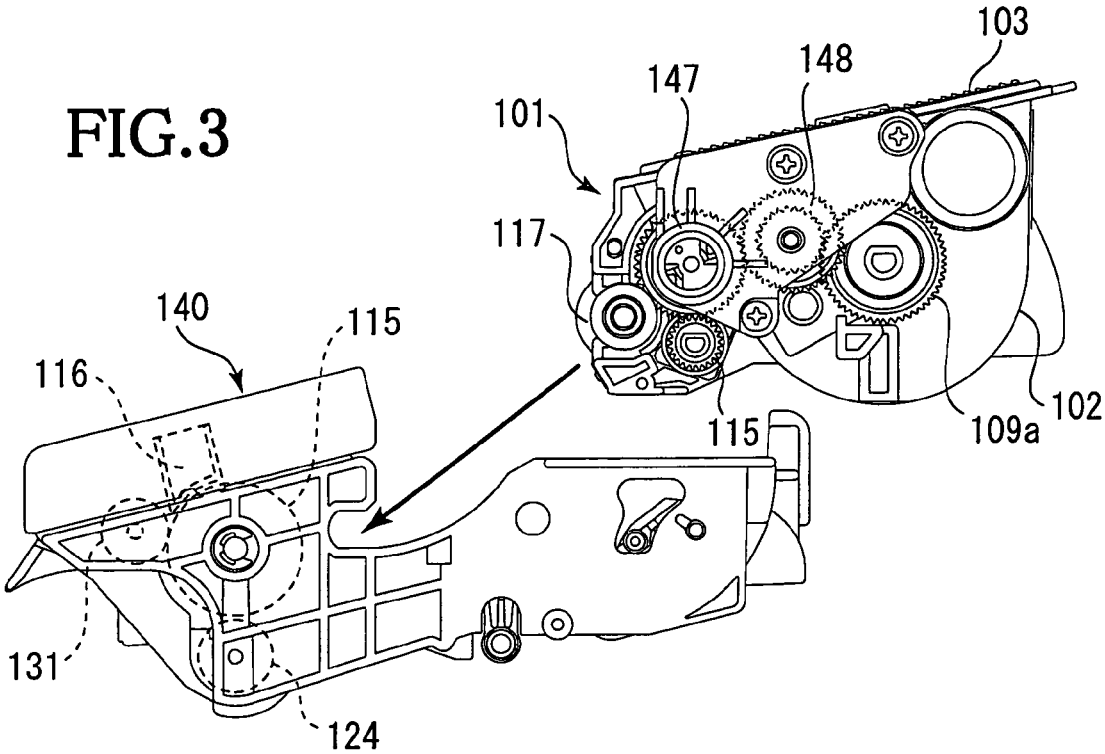
FIG. 3 is an exploded side view of the cartridge and a drum unit.
Figure 4:
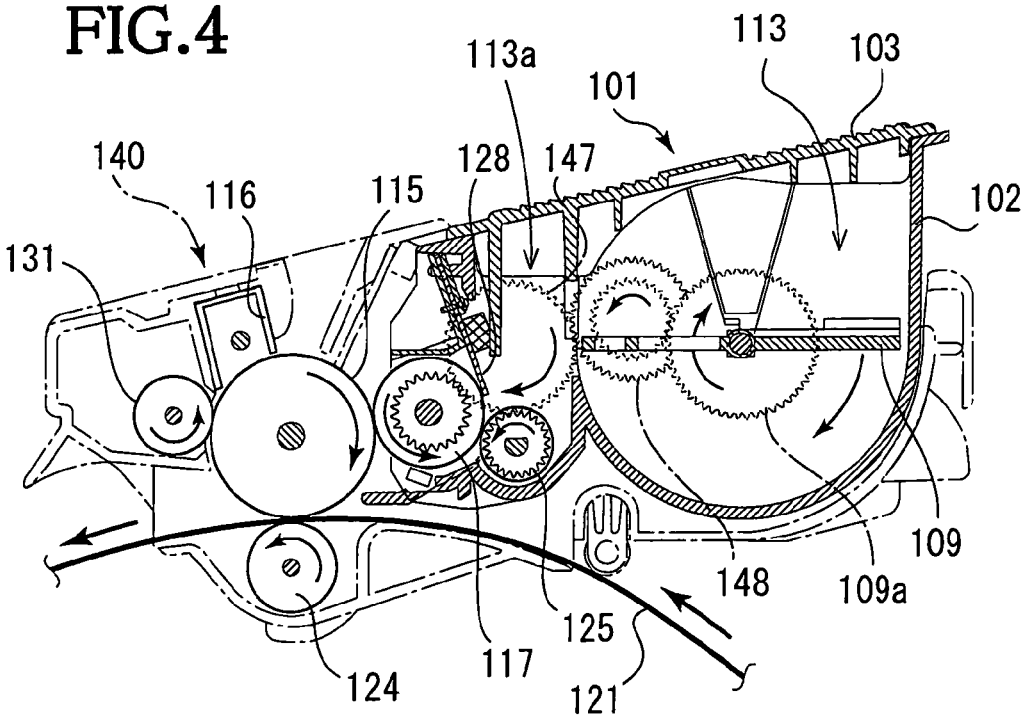
FIG. 4 is a sectional view of the cartridge and the drum unit set in a printer.

As shown in FIGS. 3 and 4, the cartridge 101 is removably set relative to a drum unit 140. Disposed in the drum unit 140 are a photosensitive drum 115, a charger 116, a transfer roller 124, and a cleaning roller 131. During a printing operation, a sheet 121 is fed from a sheet feed tray (not shown) toward the drum unit 140, and guided to a transfer position where the photosensitive drum 115 and the transfer roller 124 contact each other.

As the gear 147 is driven in a direction indicated by the arrow in FIG. 4, the agitator gear 109*a* is driven through the gear 148, to rotate the agitator 109. The toner 114 in the toner reservoir 113 is supplied to the toner supply portion 113a, while agitated by the agitator 109.

In accordance with the rotation of the gear 147, the developing roller 117 and the supply roller 125 rotate in the direction indicated by the respective arrows in FIG. 4. The toner 114 in the toner supply portion 113*a* attaches to an outer surface of the supply roller 125. The toner 114 attached to the supply roller 125 is carried on an outer surface of the developing roller 117 where a layer of the toner 114 is regulated by the blade 128 into a constant thickness.

The photosensitive drum 115 of the drum unit 140 rotates at a constant speed in a direction indicated by the arrow in FIG. 4. The transfer roller 124 rotates in a direction indicated by the arrow in FIG. 4. An outer surface of the photosensitive drum 115 is charged by the charger 116. The charged surface of the photosensitive drum 115 is irradiated with a laser beam to form an electrostatic latent image on the outer surface the photosensitive drum 115.

As the toner 114 attached to the developing roller 117 passes between the blade 128 and the developing roller 117 while the developing roller 117 is rotating, the toner 114 is frictionally charged. As the toner 114 attached to the developing roller 117 is brought into confrontation with the surface of the photosensitive drum 115, the toner 114 is attracted by an electrostatic force to the electrostatic latent image formed on the photosensitive drum 115.

As the toner 114 on the photosensitive drum 115 is brought into confrontation with the transfer roller 124, the toner 114 is transferred on the sheet 121 while the sheet 121 is held between the photosensitive drum 115 and the transfer roller 124. Thereafter, the sheet 121 is fed to a fixing unit (not shown) where the toner 114 is fixed onto the sheet 121, and then discharged.

Figure 5:
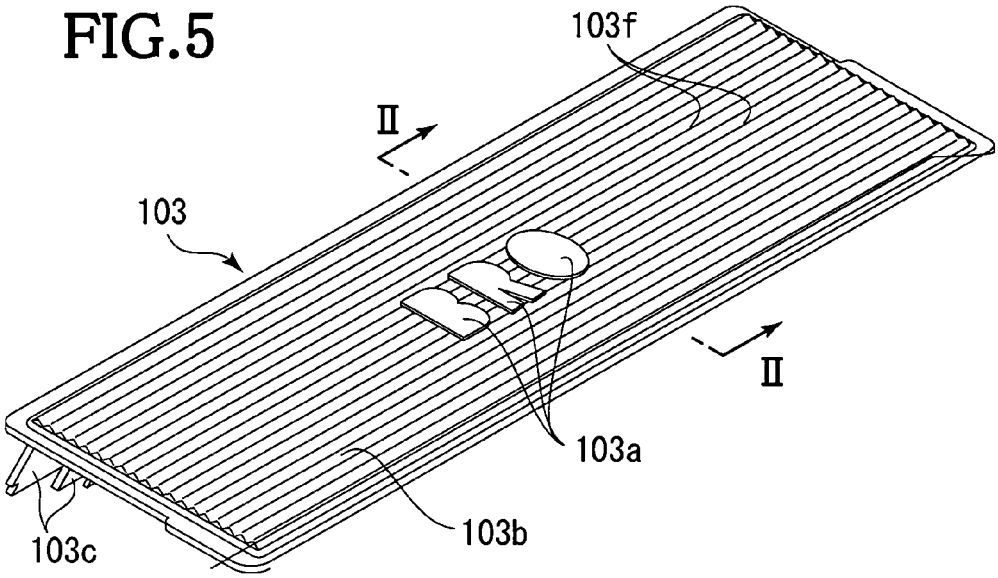
FIG. 5 is a perspective view of a top of the cartridge.

The top 103 will be described in detail below. As shown in FIG. 5, formed on a substantially central portion of the top 103 is raised land areas 103*a* (i.e., protrusion) where a symbol or logo of a company name, brand name, or product name is formed. The land areas 103*a* are disposed parallel with the longitudinal direction of the top 103. In the embodiment, characters are formed by a plurality of the land areas 103*a*.

Figure 7:
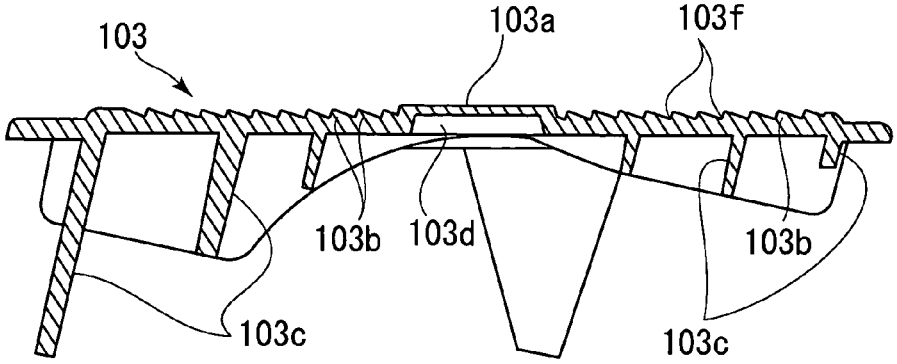
FIG. 7 is a sectional view of the top of the cartridge, taken along line II—II of FIG. 5.

Formed on the surface of the top 103 are parallel grooves 103*f* that extend toward ends of the top 103 in the longitudinal direction thereof. The parallel grooves 103*f* are not formed on the land areas 103*a*. As shown in FIG. 7, a thread 103*b* having a mountain shape in cross section is formed between the adjacent parallel grooves 103*f*. As such, the top 103 of the cartridge 101 may be formed into a substantially rectangular shape, and the threads 103*b* may have a mountain shape in cross section and extend in a longitudinal direction of the top 103. The land area 103*a* may be thus made visually significant.

The surface of the land areas 103*a* has a different pattern from its periphery where the parallel grooves 103*f* are formed. Accordingly, the symbol or logo defined by the land areas 103*a* is made significant.

The strength of the cartridge 101 is maintained by the threads 103*b* formed between the parallel grooves 103*f*, while achieving the weight reduction. The threads 103*b* serve as a slip stopper when the cartridge 101 is handled for its replacement or setting. With the plurality of the threads 103*b*, the crests 103*b*' of the threads 103*b* are touched when the cartridge 101 is handled so that slippage of the cartridge 101 out of a hand my be prevented. Even if the toner 114 is attached to the surface of the top 103 during replenishment of the toner 114 into the cartridge 101, only crests 103*b*' of the threads 103*b* are touched during handling. Therefore, a hand is relatively clean.

Formed at predetermined positions on a back 103*g* of the top 103 are guide pieces 103*c* that protrude downwardly. The guide pieces 103*c* function as guides for attaching the top 103 to the cartridge body 102.

Figure 8A:
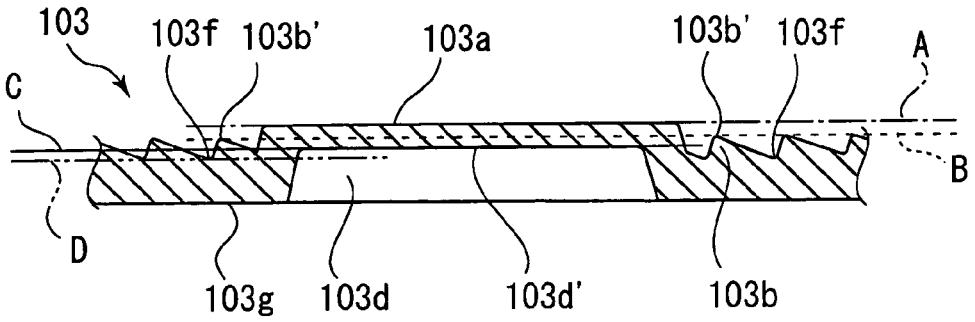
FIGS. 8A–8D are enlarged views of an essential portion of the top, showing processes for replenishing toner.

In FIG. 8A, the dot dash line A indicates a reference plane defined by the height of the surface of the land area 103*a*. The dashed line B indicates a reference plane defined by the crests 103*b*' of the threads 103*b*. The reference plane A is disposed above the reference plane B. The solid line C indicates a reference plane defined by a deepest portion 103*d*' of a recess 103*d* that is formed on the back 103*g* of the top 103 at a position associated with the land area 103*a*. The deepest portion 103*d*' corresponds to a reverse surface of the land area 103*a*. The reference plane C is disposed below the reference plane B. The double dashed chain line D indicates a reference plane defined by the deepest points of the parallel grooves 103*b*. The reference plane D is disposed below the reference plane C. As should be appreciated, by forming the land area 103*a*, the recess 103*d*, and the threads 103*b* on the top 103, a desirable symbol or logo may be more readily indicated on the top 103, as compared with the case where the desirable symbol or logo is indicated on the box-shaped housing. Also, the toner 14 may be readily filled into the cartridge 101.

The thickness of the land area 103*a* is determined by the distance between the reference planes A and C. In this embodiment, the thickness of the land area 103*a* is about 1.0 mm. The reference plane B is defined between the reference planes A and C. In other words, the crests 103*b*' of the threads 103*b* may be positioned between the deepest portion of the recess 103*d* and the surface of the land area 103*a*. Thus, a sufficient thickness is ensured for the land area 103*a*. When an impact is applied to the land area 103*a*, damage on the land area 103*a* is prevented.

The depth of the parallel groove 103*f*, that is, the distance between the crest 103*b*' of the thread 103*b* and the deepest point of the parallel groove 103*f*, is determined by the distance between the reference planes B and D. In this embodiment, the depth of the parallel groove 103*f* is about 0.7 mm. The distance between the back 103*g* of the top 103 and the reference plane D is about 1.7 mm. The distance between the reference planes A and B is about 0.5 mm. In other words, the land area 103*a* protrudes upwardly by 0.5 mm from the crests 103*b*' of the threads 103*b*. As such, the land area 103*a* may be made visually significant so that a symbol or logo formed by the land area 103*a* may be made readily visually distinguishable.

Figure 6:
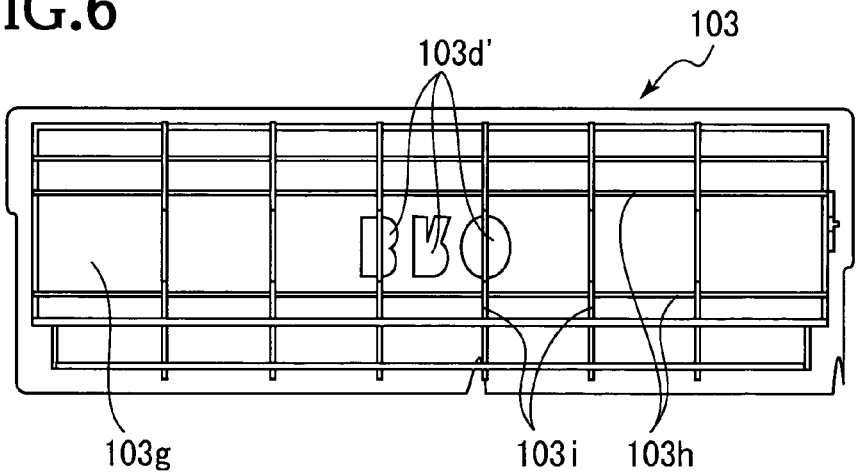
FIG. 6 is a bottom view of the top of the cartridge.

As shown in FIG. 6, the back 103*g* of the top 103 is provided with a plurality of ribs 103*h* that extend along the longitudinal direction of the top 103 and a plurality of ribs 103*i* that extend perpendicular to the ribs 103*h*. The ribs 103*h*, 103*i* cross each other. The ribs 103*i* that extend perpendicular to the ribs 103*h* are formed in the recesses 103*d*. With the ribs 103*h*, 103*i*, the rigidity of the top 103 is ensured.

Figure 8B:
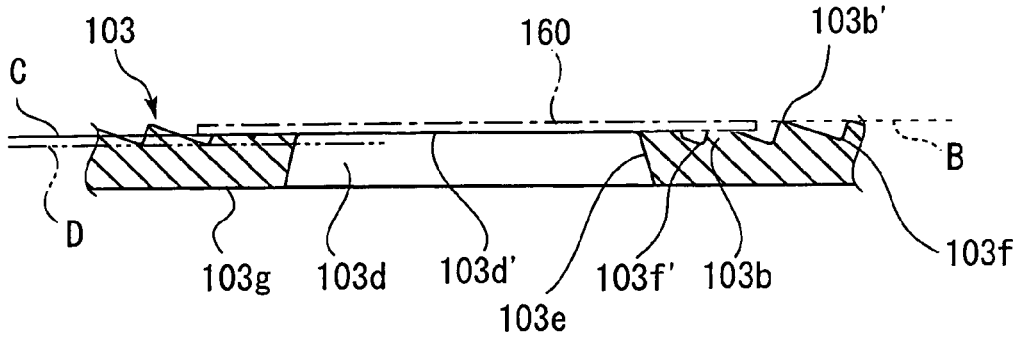

When the toner 114 contained in the cartridge 101 is used and the cartridge 101 is replenished with new toner 114, the surface of the land area 103 shown in FIG. 8A is cut off using, for example, a milling machine. As the land area 103 is gradually cut off until the thickness of the land area 103*a* is completely taken away, that is, the land area 103*a* is cut out up to the reference plane C. A port 103*e* is thus formed at a portion corresponding to the recess 103*d*, as shown in FIG. 8B. At this time, the periphery of the recess 103*d* is removed by the milling machine. In other words, the crests 103*b*' of the threads 103*b* formed near the recess 103*d* are partly removed, leaving shallow grooves 103*f*'. As should be appreciated, by forming the case of the cartridge 101 out of a synthetic resin, the synthetic resin has flexibility, so that the port 103*e* may be formed readily. In addition, the synthetic resin is strong to an impact externally applied.

As the port 103*e* is formed, the toner reservoir 113 is replenished with the new toner 114. After the toner 114 is replenished, a label 160 is attached, using an adhesive to reuse the cartage 101, as shown by the dot dash line in FIG. 8B.

Figure 8C:
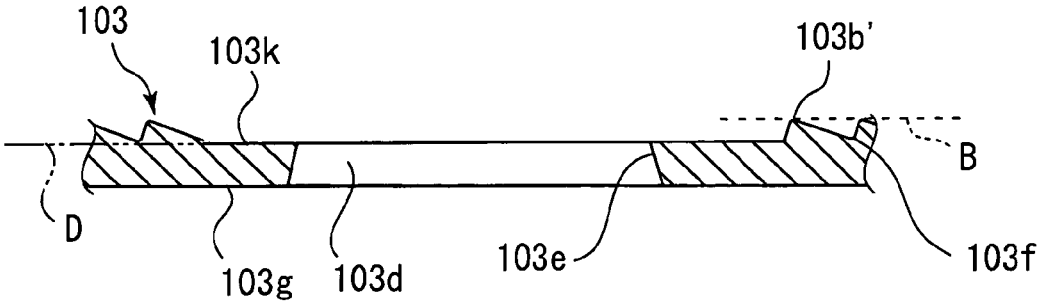
Figure 9A:
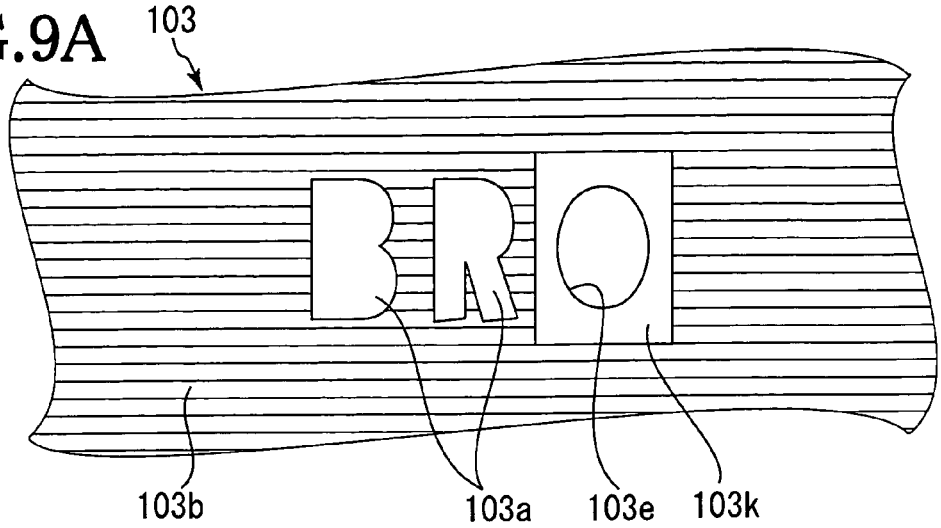
FIGS. 9A–9C are partially enlarged views of the top.

As shown in FIG. 8B, the label 160 is attached to the portion where the shallow grooves 103*f*' are formed. Therefore, sufficient bonding strength may not be obtained, and the label 160 may be peeled off. If the label 160 is peeled off, the toner 114 comes out. Accordingly, the top 103 is cut off using the milling machine to make the heights of threads 103*b* around the port 103*e* reduced to the reference plane D, as shown in FIG. 8C. In this state, a flat area 103*k* is formed around the port 103*e*, as shown in FIG. 9A, and the parallel grooves 103*f* are not recognizable any more around the port 103*e*. Thus, the flat area 103*k* is readily formed by cutting off the parallel grooves 103*f* to their deepest portions.

As discussed, the deepest portion of the recess 103*d* may be toward the land area 103*a* with respect to the deepest portion of the groove 103*f* formed by the threads 103*b*. As the land area 103*a* is cut off, the port 103*e* may be formed before reaching the deepest portion of the groove 103*f*. Accordingly, a portion other than the land area 103*a* may be prevented from excessively being cut off. A flat area 103*k* may be readily formed around the port 103*e* by cutting off the groove 103*f* formed by the threads 103*b* to the deepest portion of the groove 103*f*. As such, the deepest portion of the groove 103*f* may be the reference for a cutting operation to form the port 103*e*. A should be appreciated, the threads 103*b* are formed around the flat area 103*k*. As such, the crests 103*b*' of the threads 103*b* around the flat area 103*k* may be touched when the cartridge 101 is handled, so that slippage of the cartridge 101 out of a hand may be prevented.

Figure 8D:
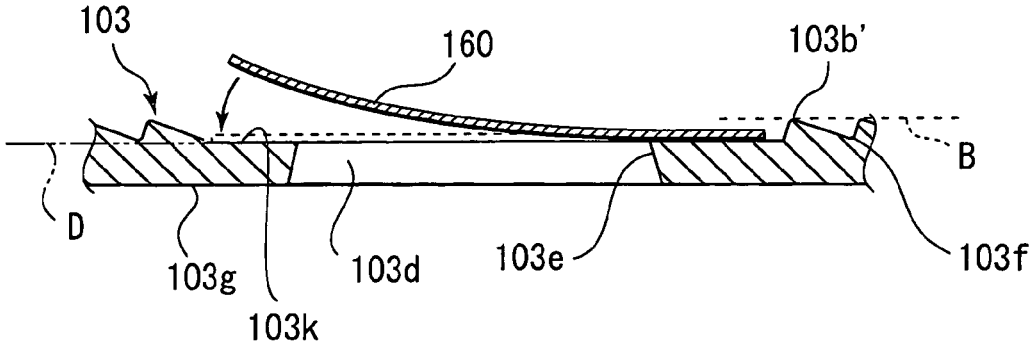
Figure 9B:
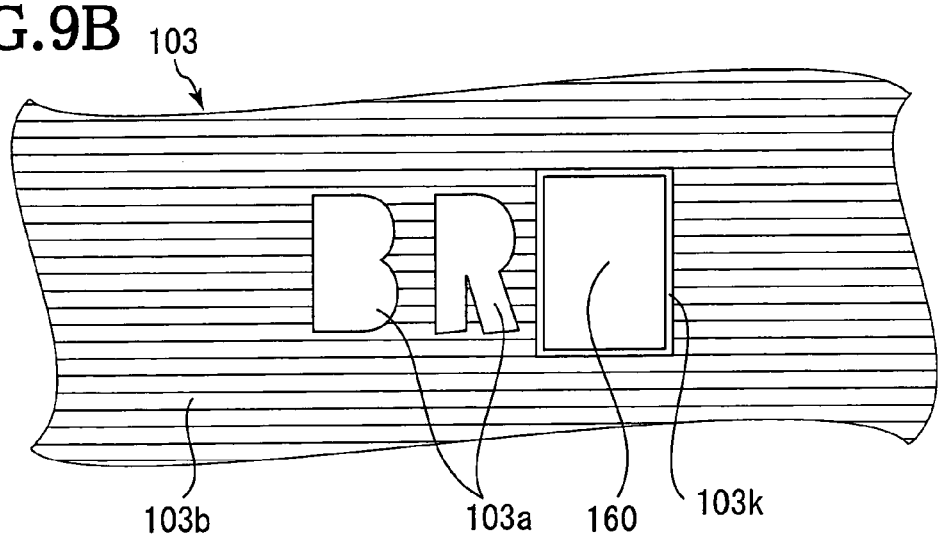

The toner reservoir 113 is replenished with the new toner 114, through the port 103*e* formed on the top 103. After the toner 114 is replenished into the toner reservoir 113, the label 160 is attached, using an adhesive, to the flat area 103*k* to cover the port 103*e*, as shown in FIGS. 8D and 9B. Thus, the cartage 101 is usable again.

The ends of the label 160 are attached to the flat area 103*k* formed around the port 103*e*, so that the sufficient bonding strength can be obtained. Therefore, the label 160 is relatively hard to peel off while the cartridge 101 is reused. As should be appreciated, when the label logo is attached to the flat area 103*k*, the plurality of threads 103*b* formed around the flat area 103*k* may enclose the label 160, so that the label 160 may not be peeled off readily. Accordingly, the cartridge 101 with the new toner 114 can be handled similarly as a new cartridge 101. The flat area 103*k* does not have to be a complete flat smooth surface. The surface of the flat area 103*k* may be rough or have some lines or grooves, as long as the sufficient bonding strength is obtained when the label 160 is attached to the flat area 103*k*.

When the toner 114 in the reused cartridge 101 runs out, the cartridge 101 is again replenished with new toner 114, through the port 103*e* by peeling off the label 160. After the toner 114 is replenished into the cartridge 101, the label 160 is attached similarly to the above-described manner, to cover the port 103*e*. Thus, the cartridge 101 is usable again.

The number of times that the cartridge 101 is reused is preferably one, in view of fine-quality image formation, because the performances of the developing roller 117, the supply roller 125 and the blade 128 provided in the cartridge 101 are not fully exerted according to the degrees of their use. This occurs due to aging and wear as the cartridge 101 is repeatedly used. The performance of the developing roller 117, the supply roller 125 and the blade 128 are also degraded because of the increased likelihood that interference could occur because of cutting chips.

As the land area 103*a* is cut off using the milling machine until the port 103*e* is formed on the top 103, as shown in FIG. 8B, the cutting chips are likely to fall into the toner reservoir 113. As the cartridge 101 is held in an upright position, when the land area 103*a* is cut off, with the longitudinal direction of the top 103 disposed vertically, entry of the cutting chips into the toner reservoir 113 becomes relatively difficult.

After the port 103*e* is formed on the top 103, as shown in FIGS. 8B or 8C, the residual toner 114 and foreign matters in the toner reservoir 113 are sucked, to mostly exclude impurities in the new toner 114 replenished into the toner reservoir 113. Thus, a printing operation is performed using the cartridge 101 replenished with such toner 114 that mostly excluding impurities.

Figure 9C:
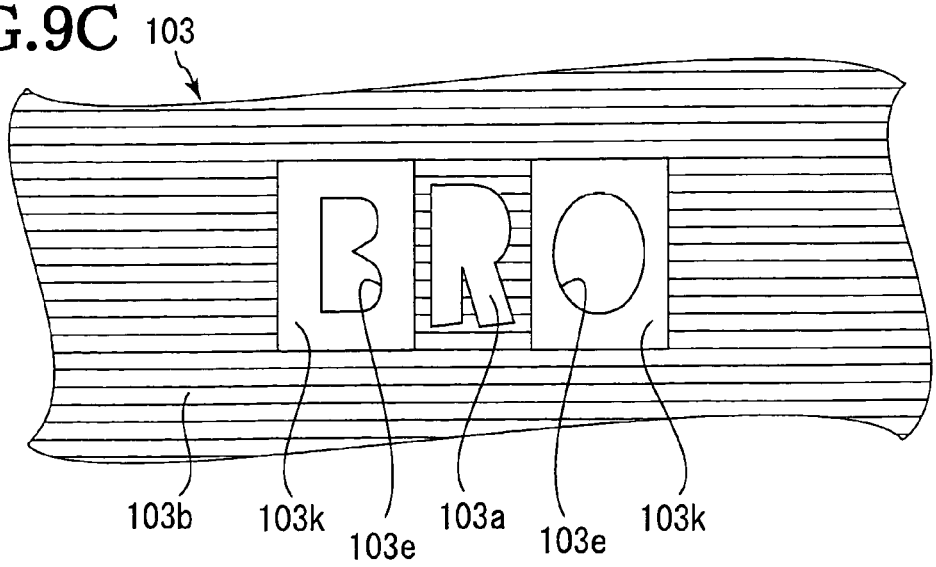

When a plurality of the ports 103*e* are formed by cutting off a plurality of the land areas 103*a*, using the milling machine, as shown in FIG. 9C, the toner 114 is replenished through one port 103*e*, and the air in the toner reservoir 113 is discharged through the other port 103*e*, so that the toner 114 is readily replenished into the toner reservoir 113.

In the cartridge 101 according to the embodiment, even when the toner 114 runs out, the land area 103*a* formed on the top 103 is cut off using, for example, the milling machine to form the port 103*e*, as shown in FIGS. 8B or 8C. The toner 114 is replenished into the toner reservoir 113 through the port 103*e*. By cutting off the surface of the top 103 using the milling machine, the agitator 109 provided in the toner reservoir 113 is not damaged, so that the cartridge 101 can be reused.

The portion where the port 103*e* is formed is predetermined and is the land area 103*a*. Therefore, such design is realized that the toner 114 is always replenished through a predetermined portion. When the toner reservoir 113 is replenished with the toner 114 through the port 103*e*, it is preferable that the toner 114 be spread evenly in the toner reservoir 113. Accordingly, the position of the land area 103*a* is designed to match with an ideal toner filling position, to increase the toner replenishing efficiency. As should be appreciated, the land area 103*a* is formed at a substantially central portion of the top 103 and the port 103*e* is formed on the land area 103*a*. The toner 114 may be filled into the cartridge 101 overall and evenly from the substantially central portion of the top 103.

As shown in FIG. 6, the ribs 103*h*, 103*i* are formed on the back 103*g* of the top 103 at positions corresponding to the land area 103*a*. With this structure, the rigidity around the port 103*e* is maintained when the land area 103*a* is cut off to form the port 103*e*.

In this embodiment, the cartridge 101 with the reference plane A disposed above the reference plane B, is described. However, the reference planes A and B may be disposed at the same level or the reference plane A may be disposed below the reference plane B.

By cutting off the land area 103*a* using any device, a port 103*e* may be readily formed at a position corresponding to the recess 103*d*. Therefore, a holing operation using a great force is not required. When the port 103*e* is formed in the cartridge 101, damage to the components disposed in the cartridge 101 may be prevented. The position of the port 103*e* may be determined at the land area 103*a*, so that a position of the port 103*e* for filling the toner 114 may be fixed. The toner 114 may also be readily filled into the cartridge 101 through the port 103*e*.

Second to seventh embodiments will be described below. It is to be noted that components according to the second to the seventh embodiments, that are similar to the first embodiment are labeled with similar reference numerals.

Figure 10A:
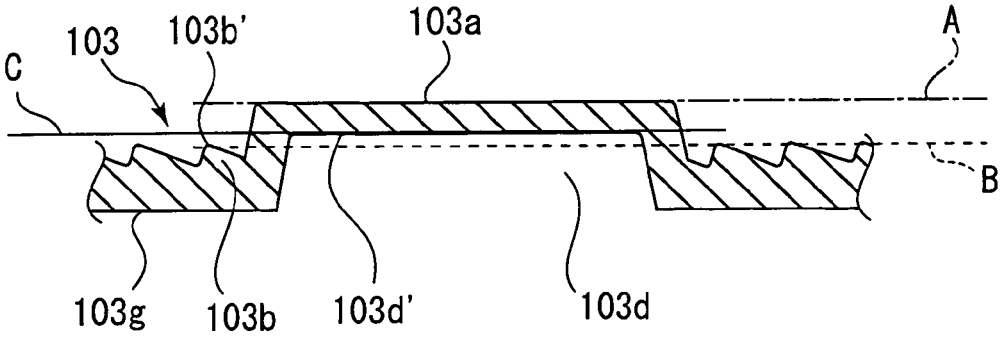
FIGS. 10A and 10B are enlarged views of an essential portion of a top according to a second embodiment of the invention.
Figure 10B:
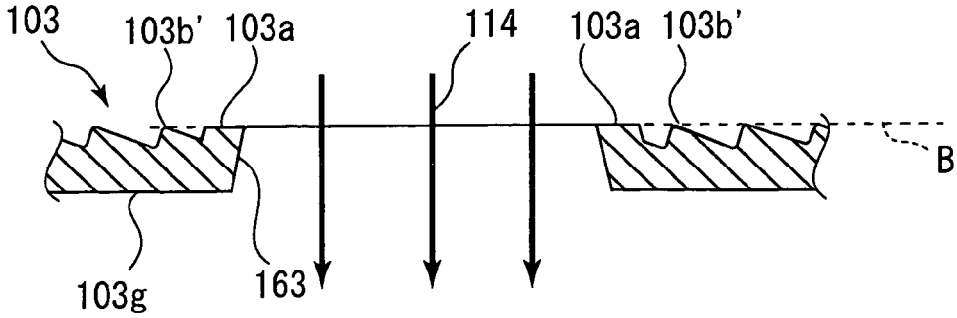

The second embodiment will be described with reference to FIGS. 10A, 10B and 11. As shown in FIG. 10A, the reference plane A defined by the height of the surface of the land area 103*a* is disposed above the reference plane B defined by the crests 103*b*' of the threads 103*b*. The recess 103*d* is formed on a reverse side of the land area 103*a*. The reference plane C defined by the deepest portion 103*d*' of the recess 103*d* is disposed above the reference plane B. The contours of the land area 103*a* and the recess 103*d* are similar to each other, but the contour of the recess 103*d* is smaller than that of the land area 103*a*.

When the cartridge 101 is replenished with the toner 114, the surface of the land area 103*a* is removed, parallel with the top 103 using, for example, a cutter, a file, or a milling machine. As the land area 103*a* is cut off to the reference plane B, a port 163 is formed at a position associated with the land area 103*a*, as shown in FIG. 10B. The cartridge 101 is replenished with toner 114 through the port 163. As the reference plane C is disposed above the reference plane B, the port 163 is formed only by cutting off the land area 103*a*.

Figure 11:
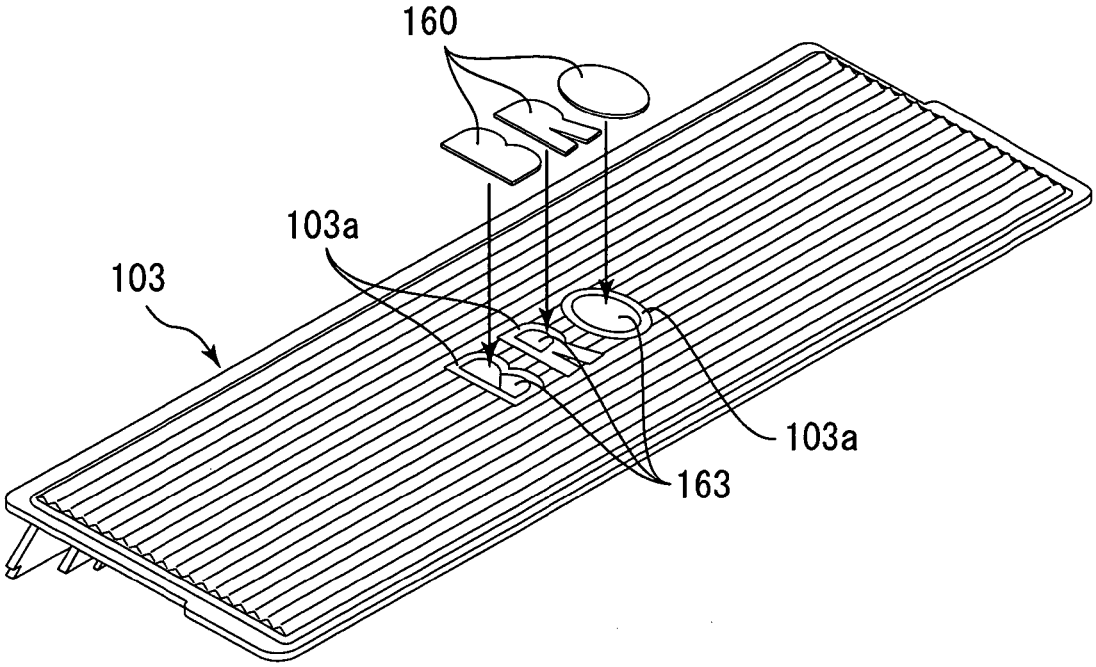
FIG. 11 is a perspective view of the top according to the second embodiment.

After the toner 114 is replenished, the port 163 is covered by attaching the label 160 shaped similar to the land area 103*a*, to the cut-off surface of the land area 103*a*, as shown in FIG. 11.

The contour of the land area 103*a* and the contour of the recess 103*d* formed on the reverse side of the land area 103*a* are similar to each other. The contour of the recess 103*d* is smaller than that of the land area 103*a*. Therefore, even after the land area 103*a* is cut off to form the port 163, a symbol or logo, which has been made significant by the land areas 103*a*, does not lose its shape. In other words, the peripheral of the port 163 formed by cutting off the land area 103*a* may be similar to the shape of the land area 103*a* as viewed from the top of the cartridge 101. Accordingly, the symbol or log does not have to be formed or displayed again on the cartridge 101 to be used again. The end of the label 160 is attached to the periphery of the port 163, so that the port 163 can be readily covered with the label 160. As should be appreciated, a flat area for attaching the label 160 may remain around the periphery of the port 163 and is formed by cutting off the land area 103*a*. The label 160 that covers the port may be readily attached to a flat area.

In the first and second embodiments, the land area 103*a* is cut to the reference plane B. However, the land area 103*a* may be cut to a different plane.

Figure 12:
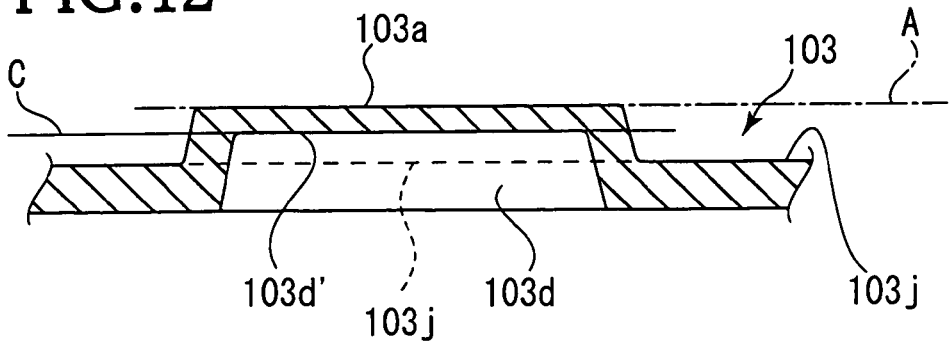
FIG. 12 is an enlarged view of an essential portion of a top according to a third embodiment of the invention.

Referring to FIG. 12, the third embodiment will be described. The top 103 has a flat surface 103*j*. As the reference plane C is set above the flat surface 103*j*, a port for replenishing the cartridge 101 with toner 114 is formed by cutting off the land area 103 to the level corresponding to the flat surface 103*j*, as indicated by the broken line in FIG. 12.

Figure 13:
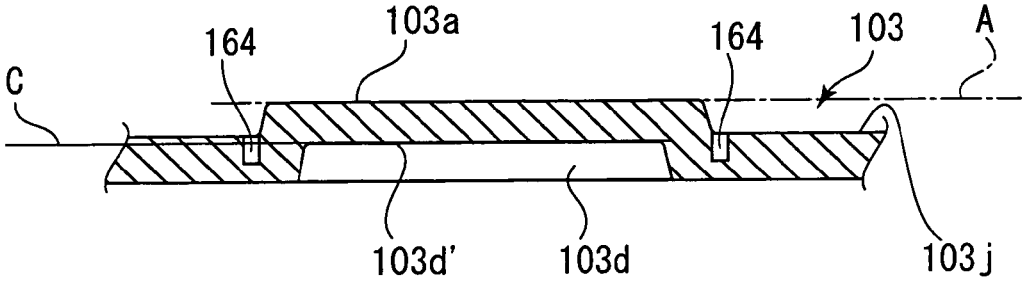
FIG. 13 is an enlarged view of an essential portion of a top according to a fourth embodiment of the invention.

Referring to FIG. 13, the fourth embodiment will be described. The reference plane C defined by the deepest portion 103*d*' of the recess 103*d* is disposed below the flat surface 103*j*. A groove 164 is formed on the flat surface 103*j* around an external boundary of the land area 103*a*. Even when the land area 103 is cut off to the level corresponding to the flat surface 103*j*, as indicated by the solid line in FIG. 13, the external boundary of the land area 103*a* is rimmed by the groove 164. Accordingly, even after the land area 103*a* is cut off, a symbol or logo, which has been made significant by the land areas 103*a*, is clearly recognizable by the groove 164.

Figure 14:
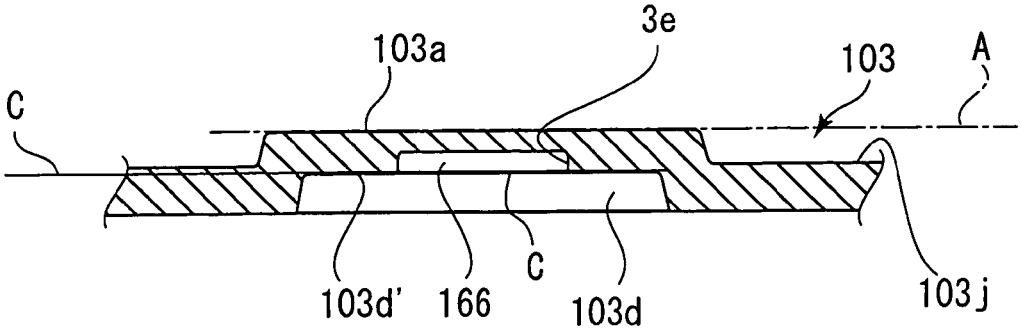
FIG. 14 is an enlarged view of an essential portion of a top according to a fifth embodiment of the invention.

Referring to FIG. 14, the fifth embodiment will be described. A recess 166 is provided on the deepest portion 103*d*' of the recess 103*d*. The recess 166 is formed in such a manner that a plane including the flat surface 103*j* traverses a space defined by the recess 166 and the reference plane C. When the land area 103*a* is cut off to the flat surface 103*j*, the port 103*e* that corresponds to the recess 166 is formed. At the time that the top 103 is designed, the position and the size of the port 103*e* can be predetermined.

Figure 15:
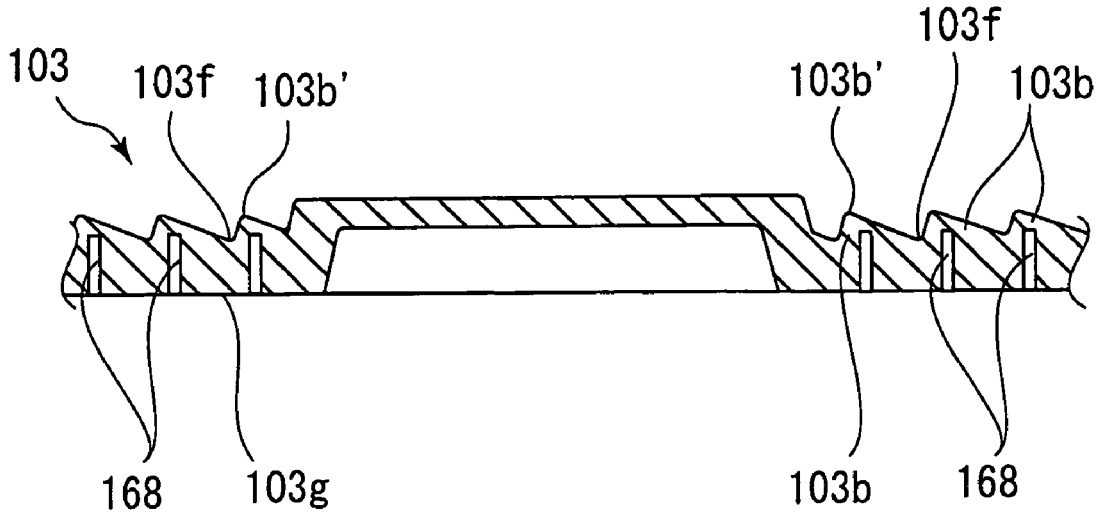
FIG. 15 is an enlarged view of an essential portion of a top according to a sixth embodiment of the invention.

Referring to FIG. 15, the sixth embodiment will be described. In the first embodiment, the threads 103*b* are formed on the surface of the top 103 to maintain the strength of the cartridge 101. In the sixth embodiment, grooves 168 are formed on the back 103*g* of the top 103, in association with the threads 103*b*. With this structure, the weight of the cartridge 101 can be reduced, while maintaining the strength of the cartridge 101.

Figure 16A:
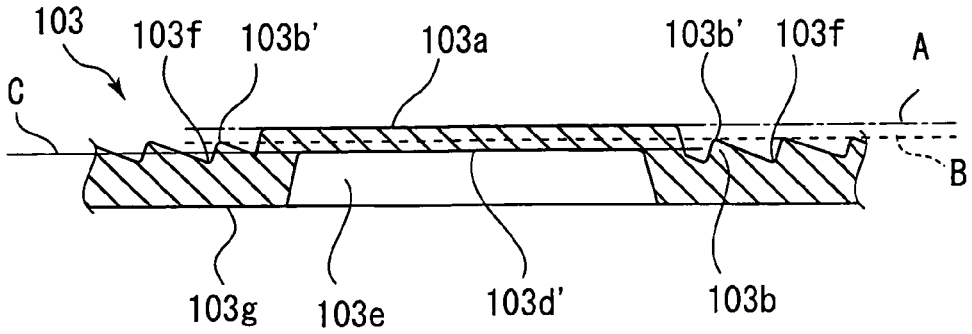
FIGS. 16A–16D are enlarged views of an essential portion of a top according to a seventh embodiment of the invention, showing processes for replenishing toner.
Figure 16B:
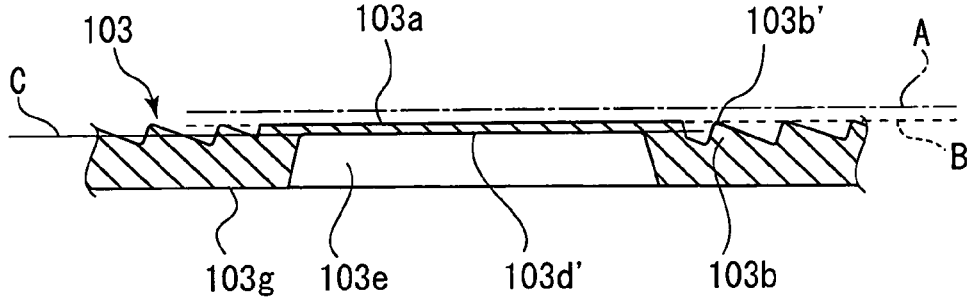
Figure 16C:
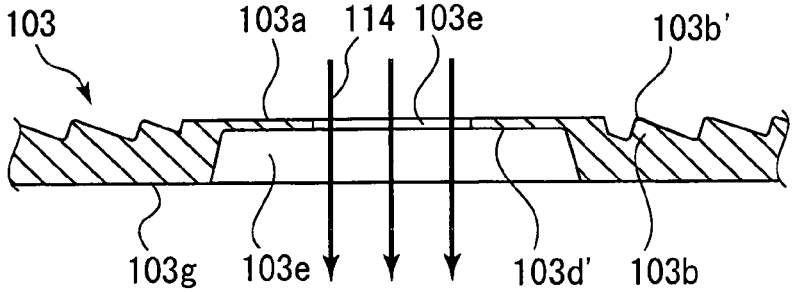
Figure 16D:
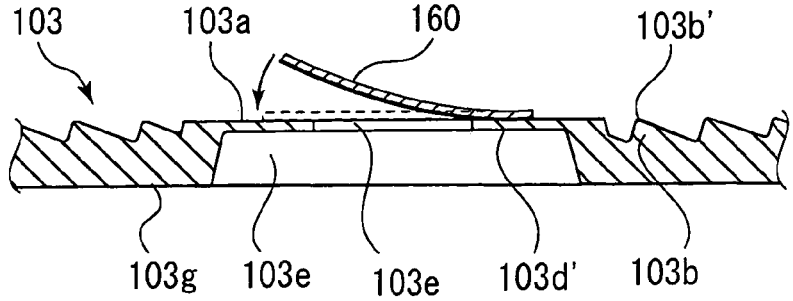
Figure 17:
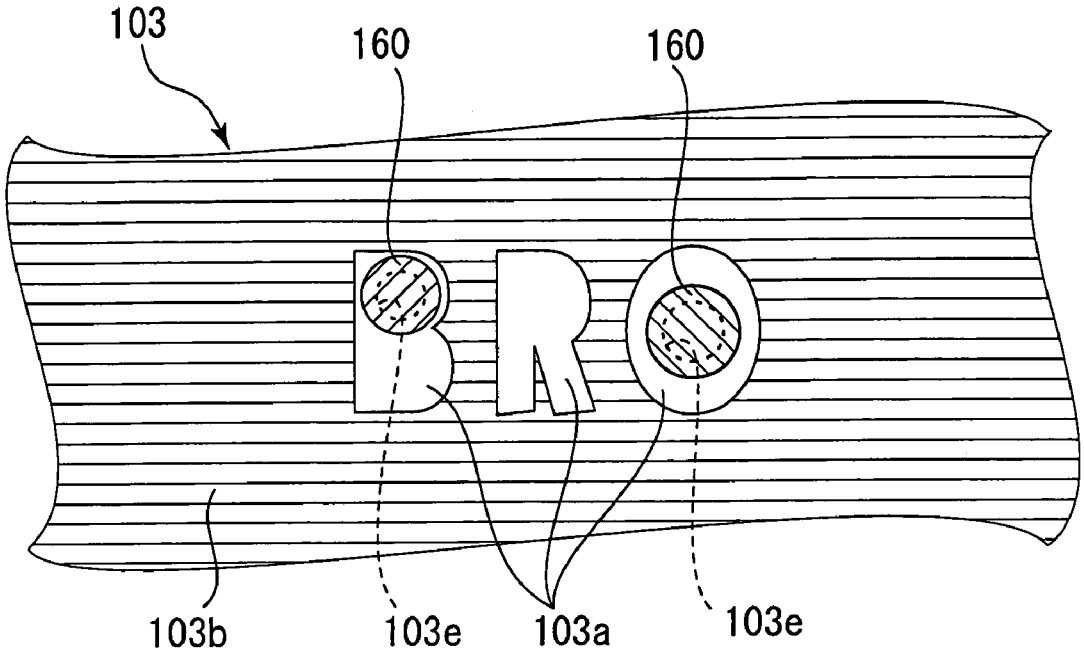
FIG. 17 is a partially enlarged view of the top according to the seventh embodiment of the invention.

Referring to FIGS. 16 and 17, the seventh embodiment will be described. The cartridge 101 according to the seventh embodiment is substantially the same as the cartridge 101 according to the first embodiment, but processes for replenishing the toner 114 into the cartridge 101 are different.

To replenish the toner 114 into the cartridge 101 according to the seventh embodiment, the surface of the land area 103*a* is removed, as a first operation, parallel with the top 103 using, for example, a cutter, a file, or a milling machine. The land area 103*a* is cut off near the reference plane B or the near the crests 103*b*', as shown in FIG. 16B.

Then, a part of the thinned land area 103*a* is removed, as a second operation, using a tool, such as a cutter, to form the port 103*e*, as shown in FIG. 16C. The toner 114 is refilled into the toner reservoir 113 though the port 103*e*, as indicated by the arrows in FIG. 16C.

In the seventh embodiment, the reference plane C defined by the deepest portion 103*d*' of the recess 103*d* is disposed below the reference plane B. Therefore, when the land area 103*a* is horizontally cut off to the reference plane B, the port 103*e* is not formed, as shown in FIG. 16B, since the thinned land area 103*a* still remains. As shown in FIG. 16C, the port 103*e* is formed by performing the second operation. Therefore, inclusion of the foreign materials into the toner reservoir 113 can be prevented when the first operation is performed.

The land areas 103*a* are disposed parallel to the longitudinal direction of the top 103 at a substantially central portion of the top 103. As shown in FIG. 17, the port 103*e* is formed on each of two land areas 103*a*. The toner 114 is filled into the toner reservoir 113 through one port 103*e*, and the air is discharged through the other port 103*e*. Thus, the air remaining in the toner reservoir 113 can be readily discharged when the toner 114 is replenished into the toner reservoir 113.

After the toner 114 is replenished into the cartridge 101, the label 160 with adhesive applied to a back surface thereof, is attached to the land area 103*a* to cover the port 103*e*, as shown in FIGS. 16A and 17. Thus, toner leakage can be prevented and the cartridge 101 replenished with the toner 114 can be used again.

When the toner 114 in the reused cartridge 101 runs out, the label 160 is removed to uncover the port 103*e*. The cartridge 101 is replenished with new toner 114 into the cartridge 101 through the port 103*e*, and the port 103*e* is then covered with the label 160. Thus, the cartridge 101 can be reused.

As shown in FIG. 17, even if the label 160 is attached to the top 103 to cover the port 103*e*, the label 160 does not impair a symbol or logo defined by the land areas 103*a*. Therefore, the symbol or logo does not have to be newly indicated or displayed on the cartridge 101 that is to be reused.

In the cartridge 101 according to the seventh embodiment, when the toner 114 runs out and the cartridge 101 needs to be replaced, the land area 103*a* is cut off parallel to the top 103 to leave the thin land area 103*a*, and the port 103*e* is then formed by removing a part of the thinned land area 103*a*. Accordingly, the cartridge 101 can be used again, and a position of the port for replenishing the toner 114 can be fixed.

While the invention has been described with reference to the first to seventh embodiments, it is to be understood that the invention is not restricted to the particular forms shown in the foregoing embodiments. Various modifications and alterations can be made thereto without departing from the scope of the invention, as set forth in the appended claims.

For example, the cartridge 101 according to the first to seventh embodiments is removably set relative to the drum unit 140. However, the invention may be applied to a process cartridge in which the cartridge 101 and the drum unit 140 are not separate but integral.

In the first to seventh embodiments, the surfaces of the land areas 103*a* are formed substantially flat. However, the surfaces of the land areas 103*a* may be textured or have patterns, as long as the land areas 103*a* have a predetermined thickness.

In the first to seventh embodiments, after the cartridge 101 is separated from the drum unit 140, the land area 103*a* is cut off, to form the port 103*e*, 163. The port 103*e*, 163 may be formed after the cartridge 101 is set relative to the drum unit 140, and then the toner 114 may be replenished into the cartridge 101.

In the first to seventh embodiments, the toner 114 is replenished through the port 103*e*, 163 formed on the top 103 of the cartridge 101. However, the port 103*e*, 163 may be formed in association with the land area 103*a* formed on the cartridge housing 102, and the toner 114 may be replenished through the port 103*e*, 163 formed on the cartridge housing 102.

The embodiments of the invention are described in conjunction with the cartridge 101 containing the toner 114. However, the invention may be applied to an ink cartridge for use in an inkjet printer.

Figure 18:
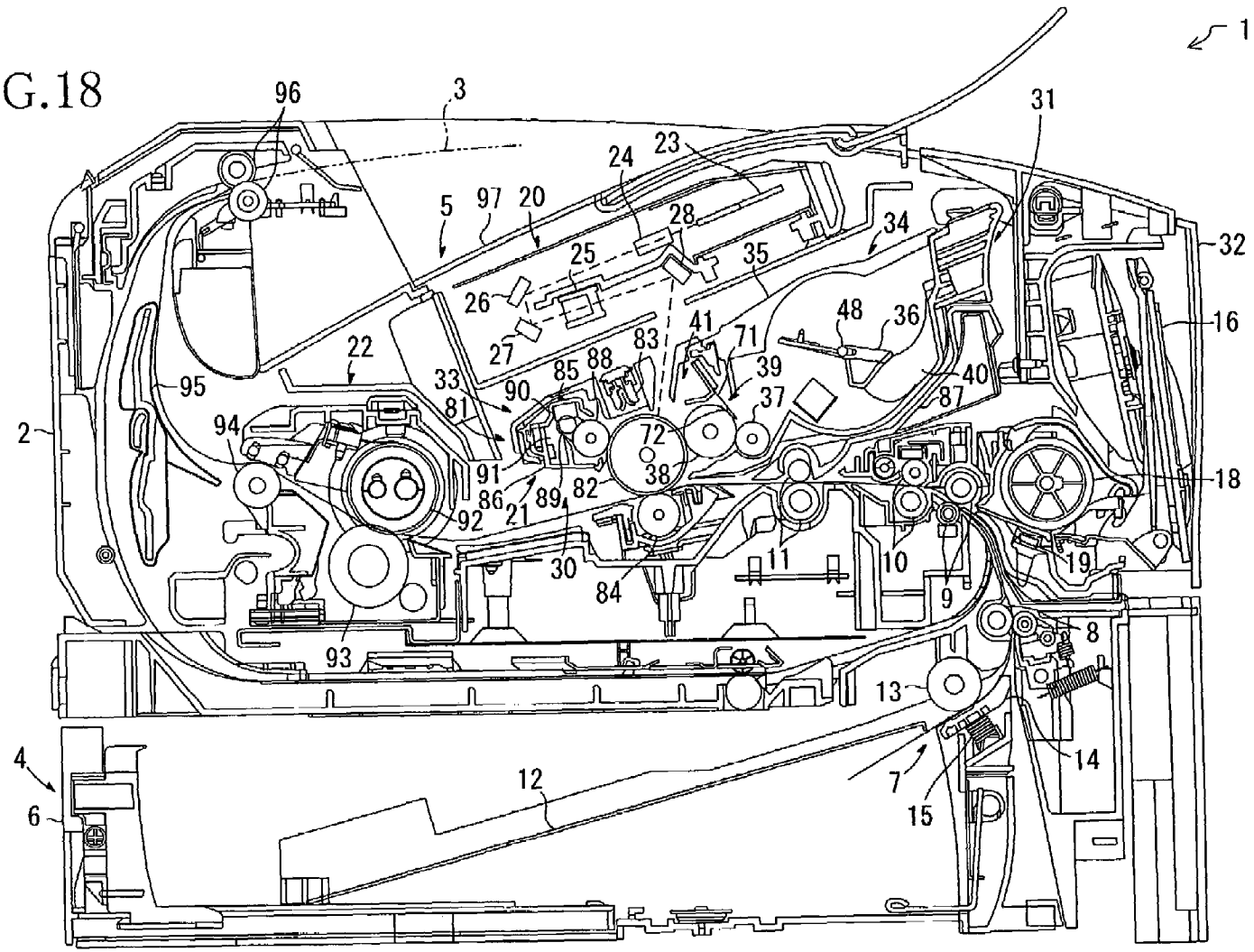
FIG. 18 is a side sectional view showing an essential portion of a laser printer according to an embodiment of the invention.

FIG. 18 is a side cross sectional view showing an essential portion of a laser printer, according to an embodiment of the invention. In FIG. 18, the laser printer 1 is an electrophotographic laser printer that forms an image in a non-magnetic single-component development system. The laser printer 1 is provided in a main frame 2 with a feeder section 4 for feeding sheets 3 and an image forming section 5 for forming images on the fed sheets 3.

The feeder section 4 includes a sheet supply tray 6 removably set on a bottom of the main frame 2, a sheet supply mechanism portion 7 disposed at one side (front side) of the sheet supply tray 6 (hereinafter an opposite side to the front side is referred to as the rear side), conveying rollers 8, 9, 10 disposed downstream of the sheet supply mechanism portion 7 in a sheet feeding direction, and register rollers 11 disposed downstream of the conveying rollers 8, 9, 10 in the sheet feeding direction.

The sheet supply tray 6 is of a box shape with an upper open construction so as to accommodate therein a stack of sheets 3. The sheet supply tray 6 is slidable substantially horizontally to the bottom of the main frame 2. A sheet mount plate 12 is provided in the sheet supply tray 6 so as to allow the sheets 3 to be stacked on the sheet mount plate 12. The sheet mount plate 12 is pivotally supported on one end far from the sheet supply mechanism portion 7, so that the other end of the sheet mount plate 12 near the sheet supply mechanism portion 7 is movable in a vertically direction. Disposed on the underside of the sheet mount plate 12 is a spring (not shown) that urges the sheet mount plate 12 upwardly. As the amount of the sheets 3 stacked on the sheet mount plate 12 increases, the sheet mount plate 12 pivots downward about the one end far from the sheet supply mechanism portion 7, against an urging force of the spring.

The sheet supply mechanism portion 7 includes a pick-up roller 13, a separation pad 14 disposed so as to face the pick-up roller 13, and a spring 15 disposed on an underside of the separation pad 14. In the sheet supply mechanism portion 7, the separation pad 14 is pressed against the pick-up roller 13 by an urging force of the spring 15.

An uppermost sheet 3 on the sheet mount plate 12 is pressed toward the pick-up roller 13 as the sheet mount plate 12 is urged upwardly by the spring. By the rotation of the pick-up roller 13, a leading end portion of the uppermost sheet 3 is nipped between the pick-up roller 13 and the separation pad 14. The sheets 3 are separated one by one in cooperation with the pick-up roller 13 and the separation pad 14. The separated sheet 3 is delivered to the register rollers 11 by the conveying rollers 8, 9, 10.

The register rollers 11 include a pair of rollers. The register rollers 11 correct the skew of the sheets 3, and then feed the sheets 3 to an image forming position where a photosensitive drum 82 and a transfer roller 84 (described below) contact each other.

The feeder section 4 of the laser printer 1 further includes a multi-purpose tray 16 on which the sheets 3 of varying size are mountable, a multi-purpose pick-up roller 18 that feeds the sheets 3 mounted on the multi-purpose tray 16, and a multi-purpose separation pad 19 disposed so as to face the multi-purpose pick-up roller 18. The multi-purpose tray 16 is accommodated in a folded manner inside a front cover 32 (described below).

The image forming section 5 includes a scanner unit 20, a process unit 21, and a fixing unit 22.

The scanner unit 20 is provided in an upper portion of the main frame 2. The scanner unit 20 includes a laser emitting portion (not shown), a polygon mirror 23, lenses 24, 25, and reflecting mirrors 26, 27, 28. A laser beam modulated based on image data is emitted from the laser emitting portion. The laser beam emitted from the laser emitting portion passes through or reflects off the polygon mirror 23, the lens 24, the reflecting mirrors 26, 27, the lens 25, and the reflecting mirror 28 in this order, as indicated by broken lines in FIG. 18, to irradiate with the laser beam a surface of the photosensitive drum 82 (described in detail below) of the process unit 21.

The process unit 21 is disposed below the scanner unit 20. The process unit 21 is removably set into the main frame 2. More specifically, the main frame 2 includes a process accommodating portion 30 for accommodating the process unit 21, an opening 31 leading to the process accommodating portion 30 for removably setting the process unit 21 in the main frame 2, and the front cover 32 for covering or uncovering the opening 31.

The process accommodating portion 30 is provided below the scanner unit 20, as a space that accommodates the process unit 21 therein. The opening 31 is formed as a path leading from the process accommodating portion 30 to the front cover 32. The front cover 32 is provided so as to extend from a front face of the main frame 2 to an upper face of the main frame 2. The front cover 32 pivots between an open position where the front cover 32 uncovers the opening 31 and a closed position where the front cover 32 covers the opening 31. With the front cover 32 being in the open position, the process unit 21 is removably set into the process accommodating portion 30, through the opening 31.

The process unit 21 includes a drum cartridge 33 detachably mounted on the main frame 2 and a developing cartridge 34 detachably set in the drum cartridge 33.

The developing cartridge 34 includes a case 35, and an agitator 36, a supply roller 37, a developing roller 38, and a layer thickness regulating blade 39 that are disposed in the case 35.

Figure 19:
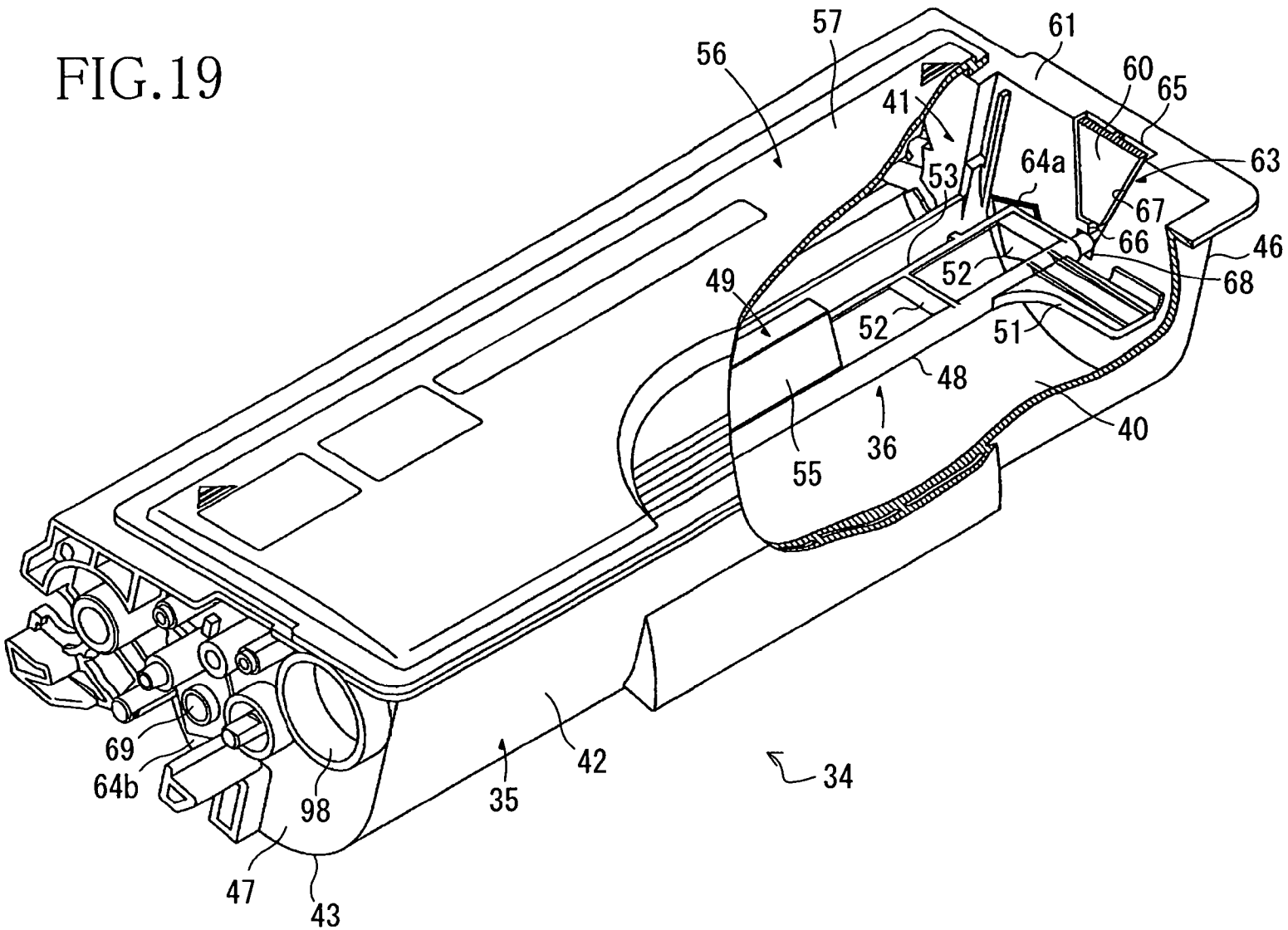
FIG. 19 is a partially cutaway perspective view of a developing cartridge of the laser printer shown in FIG. 18.
Figure 20:
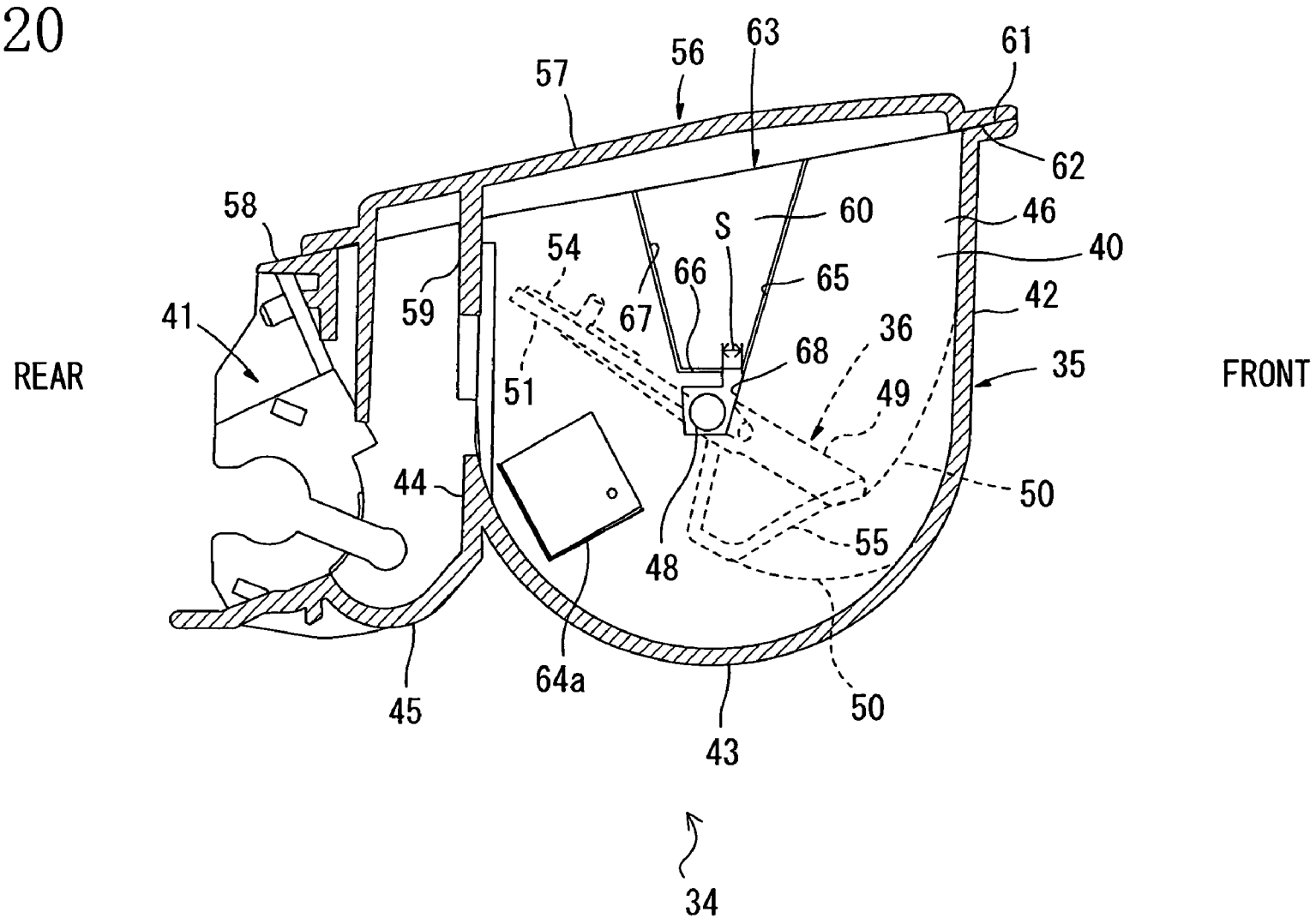
FIG. 20 is a side sectional view of the developing cartridge shown in FIG. 19.

As shown in FIGS. 19 and 20, the case 35 is provided with a front wall 42, a bottom wall 43 curved rearward from a lower end of the front wall 42, a partition wall 44 that extends upward from a rear end of the bottom wall 43, an underside wall 45 that extends rearward from a lower end of the partition wall 44, and a blade supporting wall 58 formed above the underside wall 45.

The front wall 42, the bottom wall 43, the partition wall 44, the underside wall 45, and the blade supporting wall 58 are integrally formed with side walls 46, 47 provided on each side in a width direction of the walls 42, 43 44, 45, 58 (that is, a width direction of the case 35 perpendicular to the frontward and rearward direction).

A space having a substantially "U" shape in cross section is defined in a front portion of the case 35 by the front wall 42, the bottom wall 43, the partition wall 44, and the side walls 46, 47. The space is formed as a toner containing chamber 40 where a developing agent is contained. A space defined in a rear portion of the case 35 by the partition wall 44, the underside wall 45, the blade supporting wall 58, and the side walls 46, 47 is formed as a developing chamber 41.

Figure 21:
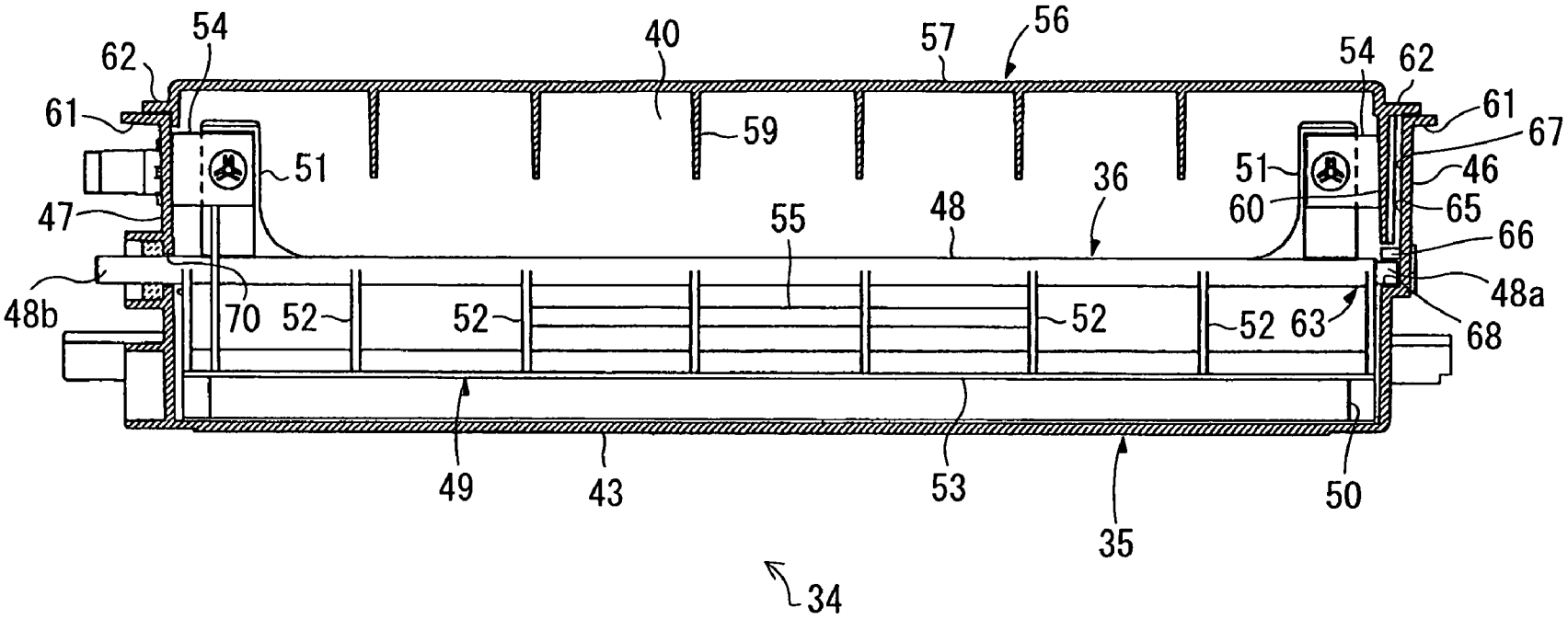
FIG. 21 is a longitudinal sectional view of the developing cartridge shown in FIG. 19.

As shown in FIG. 21, the case 35 is provided on an upper edge thereof with a lower contact portion 61 on which an upper cover 56 (described below) is positioned. The lower contact portion 61 is integrally formed with the case 35 to extend substantially horizontally.

As shown in FIGS. 20 and 21, the case 35 is provided with the upper cover 56 that covers an upward opening portion of the case 35. The upper cover 56 is formed separately from the case 35. An upper plate 57 that covers the upward opening portion of the case 35 is integrally formed with upper partitions 59 that extend downwardly from the upper plate 57 in a position to face the partition wall 44.

As shown in FIG.21, the upper plate 57 is provided on a periphery thereof with an upper contact portion 62 positioned on the lower contact portion 61 of the case 35. The upper contact portion 62 is integrally formed with the upper plate 57 to extend substantially horizontally.

An engaging plate 60 that engages with a guide portion 67 of a recessed groove 65 (described below) is disposed on an end portion of the upper plate 57 in a width direction of the upper plate 57, as shown in FIGS. 19 and 20.

The engaging plate 60 is shaped similar to the guide portion 67 of the recessed groove 65. The engaging plate 60 is of a substantially inverted trapezoidal shape in side view, with the width of the engaging plate 60 narrower from its upper end toward its lower end. In the upper plate 57 attached to the case 35, as shown in FIG. 21, the engaging plate 60 extending downwardly from the upper contact portion 62 is positioned inward of the case 35 in the width direction thereof, to face the recessed groove 65, which is disposed partway in the forward and rearward direction of the case 35.

The thickness of the engaging plate 60 is substantially the same as the depth of the recessed groove 65. A surface of the engaging plate 60 engaging with the recessed groove 65, is flush with the surface of the side wall 46.

The toner containing chamber 40 accommodates, as a developing agent, positively chargeable non-magnetic single component toner. The toner is, for example, polymerized toner that is obtained by copolymerizing polymerizable monomers using a known polymerization method, such as a suspension polymerization method. The polymerizable monomers may be styrene-based monomers, such as styrene, and acrylic-based monomers, such as acrylic acid, alkyl (C1–C4) acrylate, and alkyl (C1–C4) methacrylate. Polymerized toner particles are spherical in shape, having excellent fluidity. Toner particle sizes are approximately 6 to 10 μm. The toner is mixed with a coloring material, such as carbon black, and wax, as well as an external additive, such as silica, to improve the fluidity of the toner.

The agitator 36 is disposed in the toner containing chamber 40. As shown in FIG. 21, the agitator 36 includes a shaft 48, a wing member 49 provided on the shaft 48, a flexible film member 50 provided on the wing member 49, and a wiper supporting member 51 provided on the shaft 48. The shaft 48, the wing member 49, and the wiper supporting member 51 are integrally formed of resin material having flexibility, such as ABS resin.

The shaft 48 is disposed, in a substantially central portion of the toner containing chamber 40 in side view, between the side walls 46, 47 parallel to the width direction of the case 35. The shaft 48 is a round bar having a diameter of about 3 to 8 mm. The shaft 48 has flexibility and formed longer than a distance between the side walls 46, 47.

The wing member 49 is provided across the agitator 36 disposed in the toner containing chamber 40, in an axial direction of the agitator 36. The wing member 49 includes a plurality of vertical levers 52 and a horizontal bar 53. The vertical levers 52 are disposed along the axial direction of the shaft 48 at a predetermined interval therebetween. The vertical levers 52 are formed to extend outwardly in a diametrical direction of the shaft 48. The vertical bar 52 disposed on each end in the axial direction of the shaft 48 faces the respective side wall 46, 47 at a slight distance therebetween. The horizontal bar 53 is disposed to connect free ends of the vertical levers 52.

The film member 50 is formed of resin film, such as polyethylene telephthalate. The film member 50 is attached along the lengthwise direction of the horizontal bar 53. The film member 50 is set to such a height that flexes the film member 50 when making contact with the bottom wall 43, to agitate the toner in the toner containing chamber 40.

Integrally formed with the vertical levers 52 disposed at a substantially central portion in an axial direction of the shaft 48, is a projection 55 that projects to form a substantially trapezoidal shape in side view, as shown in FIG. 20. The film member 50 is also attached to the projection 55.

The wiper supporting member 51 is of a substantially rectangular flat plate. The wiper supporting member 51 is provided at each end of the axial direction of the shaft 48, to extend in a direction opposite to the direction that the vertical levers 52 extend. A wiper 54 that is formed of an elastic member and wipes off a residual toner amount detecting window 64*a*, 64*b*, is screwed on each wiper supporting member 51. Each wiper 54 is disposed to elastically contact the side wall 46, 47, to wipe off the residual toner amount detecting window 64*a*, 64*b*, respectively.

Provided on the side wall 46 of the toner containing chamber 40 are a shaft supporting portion 63 that supports the shaft 48 of the agitator 36 and a residual toner amount detecting window 64*a*, as shown in FIGS. 19 and 20. The shaft supporting portion 63 includes a recessed groove 65 and a restricting portion 66.

The recessed groove 65 is formed by recessing the inner wall of the side wall 46 at a substantially central portion in the forward and rearward direction of the side wall 46. An upper end of the recessed groove 65 is open. The guide portion 67 has a width gradually narrowed from the upper end to a lower end, forming a substantially inverted trapezoidal shape in side view. Integrally formed with the guide portion 67 is a deepest portion 68 formed below the guide portion 67 into a substantially rectangular shape in side view.

The restricting portion 66 extends, in a frontward and rearward direction perpendicular to a depth direction of the recessed groove 65, continuously from a rear end of the recessed groove 65 toward its front end between the guide portion 67 and the deepest portion 68. The restricting potion 66 is disposed to form a space S between the front end of the recessed groove 65 and an end of the restricting portion 66.

The restricting portion 66 is integrally formed with the side wall 46 and the recessed groove 65. The restricting portion 66 is of a substantially rectangular shape in side view. The restricting portion 66 has a thickness that becomes flush with an inner surface of the side wall 46. The width of the space S defined between the restricting portion 66 and the front end of the recessed groove 65 is set to a length smaller than a diameter of the shaft 48 of the agitator 36.

In the recessed groove 65, the length of deepest portion 68 in the frontward and rearward direction is set to slightly longer than the diameter of the shaft 48 of the agitator 36.

The depth of the deepest portion 68 from a bottom thereof to an underside of the restricting portion 66 is also set to slightly longer than the diameter of the shaft 48 of the agitator 36.

The residual toner amount detecting window 64*a* is provided on the side wall 46 at a lower rear side of the toner containing chamber 40. The residual toner amount detecting windows 64*a* is embedded in a substantially rectangular opening in side view that passes through the side wall 46 in a thickness direction thereof. An inner surface of the residual toner amount detecting window 64*a* is flush with an inner surface of the side wall 46. Provided on an outer surface of the residual toner amount detecting window 64*a*, is a cylindrical light transmission portion 69, which is similar to a light transmission portion 69 provided on the residual toner amount detecting window 64*b*, as shown in FIG. 19.

Provided on the side wall 47 are a through hole 70 inserted over the shaft 48 of the agitator 36, the residual toner amount detecting windows 64*b*, and a toner filling port 98.

As shown in FIG. 21, the through hole 70 is formed on the side wall 47 so as to pass through the side wall 47 in a width direction thereof, at a position facing the deepest portion 68 formed on the side wall 46. The diameter of the through hole 70 is substantially the same as that of the shaft 48 of the agitator 36.

The residual toner amount detecting window 64*b* is provided on the-side wall 47 at a position facing the residual toner amount detecting window 64*a* formed on the side wall 46. The residual toner amount detecting windows 64*b* is embedded in a substantially rectangular opening in side view that passes through the side wall 47 in a thickness direction thereof. An inner surface of the residual toner amount detecting window 64*b* is flush with an inner surface of the side wall 47. A cylindrical light transmission portion 69 is provided on an outer surface of the residual toner amount detecting window 64*b*, as shown in FIG. 19.

Figure 22:
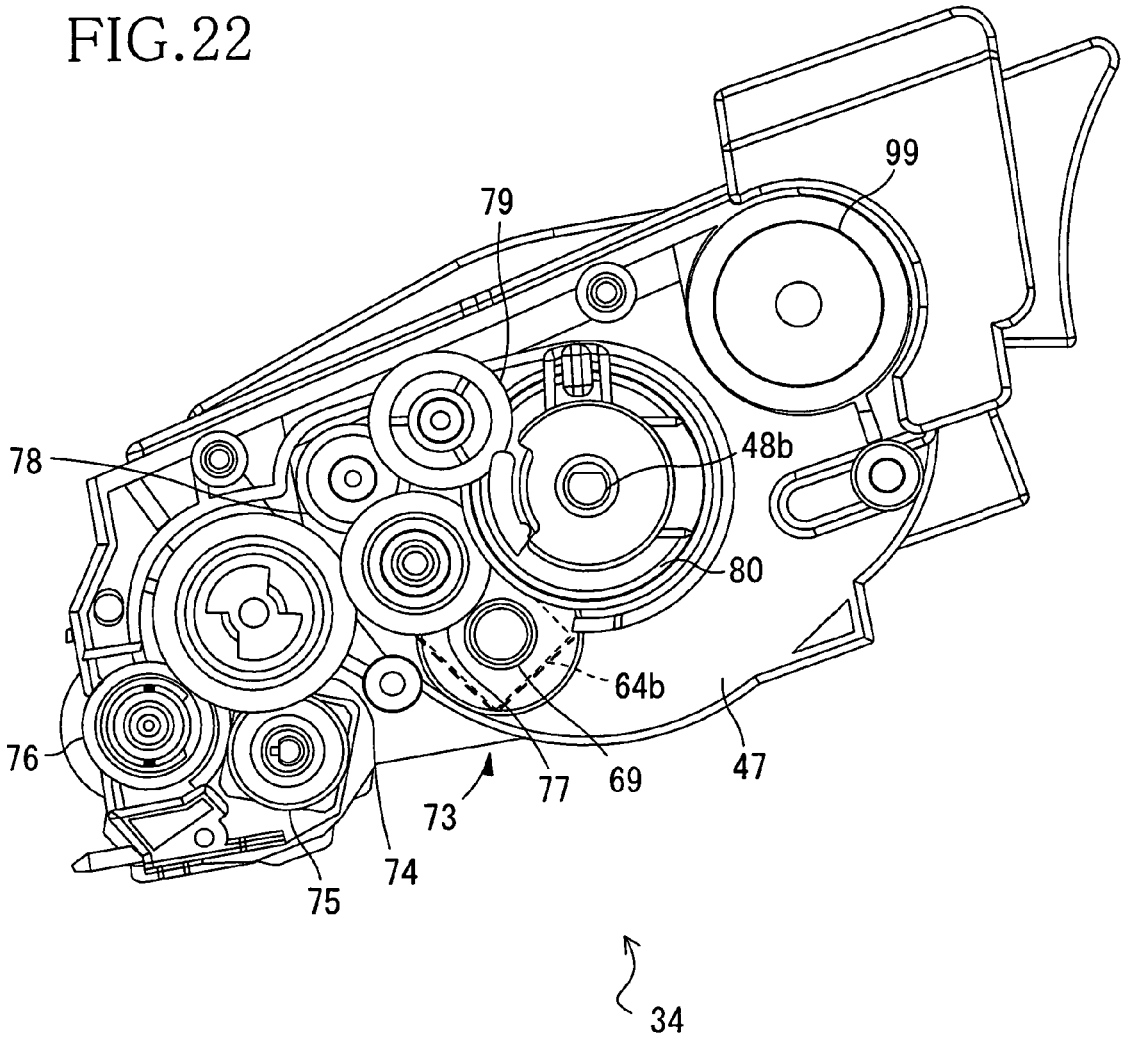
FIG. 22 is a side view of the developing cartridge shown in FIG. 19, showing a gear mechanism portion.

The toner filling port 98 is formed into a substantially round shape on the front side of the side wall 47, so as to pass through the side wall 47 in a thickness direction thereof, as shown in FIG. 19. With the toner filled into the toner containing chamber 40, the toner filling port 98 is coveted with a cap 99, as shown in FIG. 22.

Figure 23A:
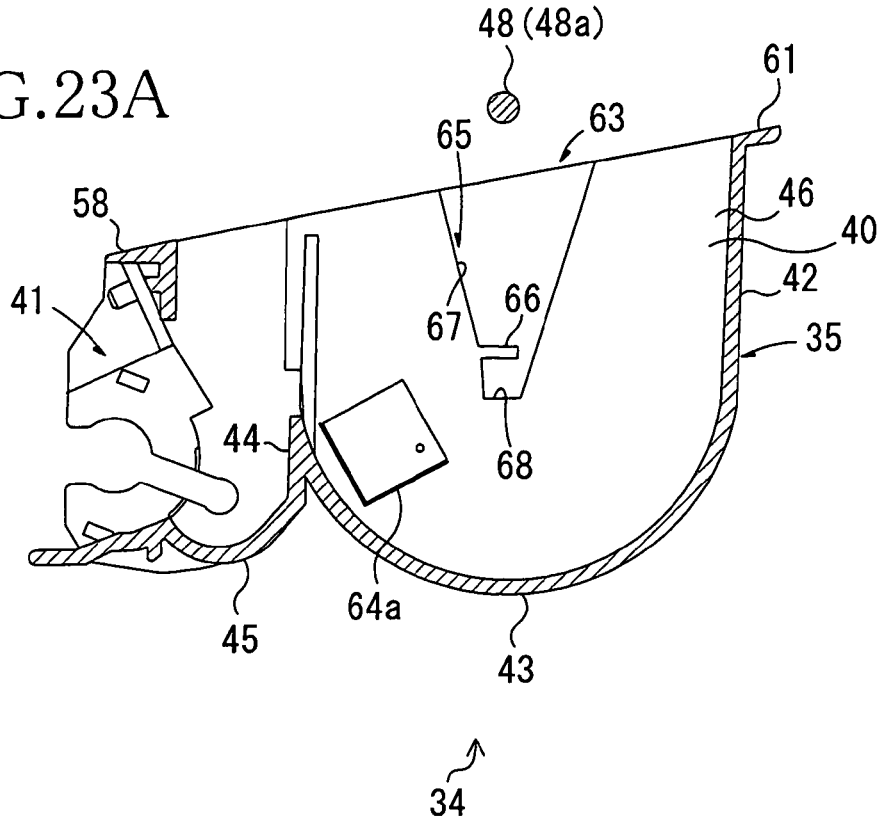
FIG. 23A is a side sectional view of the developing cartridge, showing a shaft of an agitator to be fitted in a recessed groove.
Figure 23B:
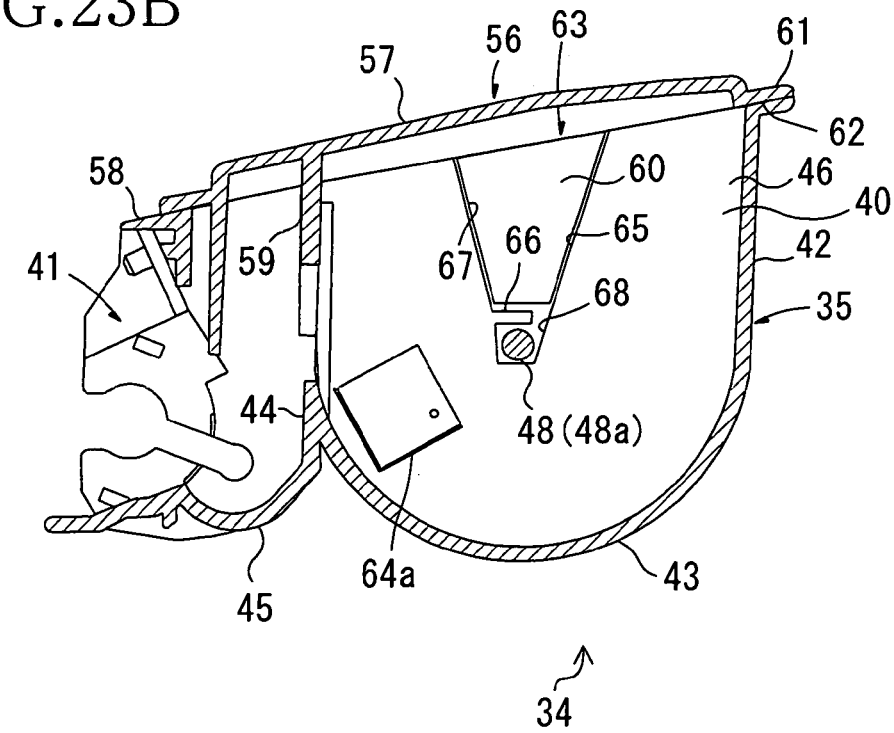
FIG. 23B is a side sectional view of the developing cartridge, showing the shaft of the agitator fitted in a deepest portion of the recessed groove.

The agitator 36 is set in the toner containing chamber 40 of the case 35 in the following manner. An end 48*b* of the shaft 48 is inserted into the through hole 70 formed on the side wall 47. Thereafter, the shaft 48 of the agitator 36 is flexed in an axial direction thereof by its own elasticity. An end 48*a* of the shaft 48 is inserted into the guide portion 67 of the recessed groove 65 from its upper end toward its lower end, as shown in FIG. 23A. The shaft 48 is guided toward the deepest portion 68 along the shape of the recessed groove 65. As the end 48*a* makes contact with the restricting portion 66, the shaft 48 moves beyond the restricting portion 66 while is being flexed, and is inserted in the deepest portion 68. The diameter of the shaft 48 is greater than the width of the space S. As the end 48*a* of the shaft 48 passes through the space S, the degree of flexing of the shaft 48 is relatively and slightly lowered. Accordingly, breakage of the shaft 48 is prevented. Thus, the shaft 48 of the agitator 36 is set in the shaft supporting portion 63.

Thereafter, the upper cover 56 is set from above onto the case 35 while inserting the engaging plate 60 of the upper cover 56 into the guide portion 67 of the recessed groove 65, to contact the upper contact portion 62 of the upper cover 56 to the lower contact portion 61 of the case 35. Thereafter, the upper contact portion 62 and the lower contact portion 61 are connected by with ultrasonic welding. Thus, the upper cover 56 covers the upward opening of the case 35 with the engaging plate 60 of the upper cover 56 engaging in the guide portion 67 of the recessed groove 65. With the upper cover 56 set in the case 35, as described above, the engaging plate 60 of the upper cover 56 is flush with an inner surface of the side wall 46. The engaging plate 60 that becomes flush with the inner surface of the side wall 46 engages with the recessed groove 65, so that the toner may be prevented from building up in the recessed groove 65. With the engaging plate 60 engaging with the recessed groove 65, the engaging plate 60 may be flush with the inner surface of the side wall 46, so that distance between the side wall 46 including the engaging plate 60 and the agitator 36 may be set substantially equally. By setting the distance between the agitator 36 and the side wall 46 including the engaging plate 60 to a small amount, the amount of toner that enters therebetween may be reduced. Thus, an agitating efficiency of the toner may be improved. As should be appreciated, the end of the shaft 48 of the agitator 36 may be fixed at the deepest portion 68 of the recessed groove 65 and the other end of the shaft 48 of the agitator 36 may be inserted into the through hole 70. Accordingly, the shaft 48 of the agitator 36 may be supported without looseness or rattle. After an end of the shaft 48 of the agitator 36 is inserted into the through hole 70, the shaft 48 may be flexed, to set the other end of the agitator 36 in the shaft supporting portion 63. Thus, the shaft 48 of the agitator 36 may be securely supported at the deepest portion 68.

The supply roller 37, the developing roller 38, and the layer thickness regulating blade 39 are disposed in the developing chamber 41, as shown in FIG. 18.

The supply roller 37 is disposed on a rear portion of the toner containing chamber 40, along the width direction of the case 35. The supply roller 37 is rotatably supported on the side walls 46, 47. The supply roller 37 is rotatable in a direction opposite to a rotating direction of the agitator 35. The supply roller 37 includes a metal roller shaft covered by a roller portion formed of conductive urethane sponge.

The developing roller 38 is disposed behind the supply roller 37, along the width direction of the case 35. The developing roller 38 is rotatably supported on the side walls 46, 47. The developing roller 38 is rotatable in the same direction as the supply roller 37.

The developing roller 38 includes a metal roller shaft covered by a roller portion formed of a conductive elastic material. A surface of the roller portion of the developing roller 38 is coated with urethane rubber or silicone rubber including fluorine. The roller portion of the developing roller 38 is formed of conductive urethane rubber or silicone rubber including fine carbon particles. A development bias is applied by a power supply (not shown) to the roller shaft of the developing roller 38.

The supply roller 37 and the developing roller 38 are disposed so as to face each other. The supply roller 37 and the developing roller 38 contact each other such that the supply roller 37 applies some pressures to the developing roller 38. As the supply roller 37 and the developing roller 38 rotate in the same direction, the supply roller 37 and the developing roller 38 rotate or move in the opposite directions from each other at a contact portion therebetween.

The layer thickness regulating blade 39 is supported by the blade supporting wall 58 above the supply roller 37. The layer thickness regulating blade 39 is disposed between positions where the developing roller 38 faces the supply roller 37 and the photosensitive drum 28 in the rotating direction of the developing roller 38.

The regulating blade 39 is a long plate extending along an axial direction of the developing roller 38 to face the developing roller 38. The regulating blade 39 includes a plate spring member 71, and a pressing portion 72 attached to one end of the plate spring member 71 and formed of insulating silicone rubber. With the plate spring member 71 being supported by the blade supporting wall 58, the pressing portion 72 presses the surface of the developing roller 38 with the elasticity of the plate spring member 71.

The developing cartridge 34 is provided with a gear mechanism portion 73, as shown in FIG. 22, that drives the agitator 36, the supply roller 37, and the developing roller 38 to rotate. The gear mechanism portion 73 is disposed on an outer face of the side wall 47. The gear mechanism portion 73 includes an input gear 74, a supply roller drive gear 75, a developing roller drive gear 76, a first intermediate gear 77, a second intermediate gear 78, a third intermediate gear 79, and an agitator drive gear 80.

The input gear 74 is rotatably provided on an outer face of the side wall 47 between the developing roller 38 and the agitator 36. Drive force from a motor (not shown) is input to the input gear 74.

The supply roller drive gear 75 is mounted on an end of the roller shaft of the supply roller 37. The supply roller drive gear 75 is provided below the input gear 74, to engage with the input gear 74.

The developing roller drive gear 76 is mounted on an end of the roller shaft of the developing roller 38. The developing roller drive gear 76 is provided on a rear side of the input gear 74, to engage with the input gear 74.

The first intermediate gear 77 is rotatably provided on the outer face of the side wall 47 to engage with the input gear 74 at a front side of the input gear 74.

The second intermediate gear 78 is rotatably provided above the first intermediate gear 77 on the outer face of the side wall 47, to engage with the first intermediate gear 77.

The third intermediate gear 79 is rotatably provided on the outer face of the side wall 47, to engage with the second intermediate gear 78 at a front side of the second intermediate gear 78.

The agitator drive gear 80 is disposed on a lower front side of the third intermediate gear 79. The agitator drive gear 80 is mounted on an end of the shaft 48*b* of the agitator 36 inserted into the through hole 70, to engage with the third intermediate gear 79.

As the drive force is input to the input gear 74 from the motor (not shown), the drive force is transmitted to the supply roller drive gear 75 and the developing roller drive gear 76, to rotate the supply roller 37 and the developing roller 38, respectively.

The drive force input to the input gear 74 is transmitted to the agitator drive gear 80, through the first intermediate gear 77, the second intermediate gear 78, and the third intermediate gear 79. Accordingly, the shaft 48 of the agitator 36 is rotated.

As shown in FIGS. 18 and 20, the toner contained in the toner containing chamber 40 is scooped up by the film member 50 according to the rotation of the agitator 36 and conveyed to the developing chamber 41 through the partition wall 44 and the upper partition 59.

The toner conveyed to the developing chamber 41 is supplied to the developing roller 38 by the rotation of the supply roller 37. When the toner is supplied from the supply roller 37 to the developing roller 38, the toner is positively charged by the friction between the supply roller 37 and the developing roller 38.

The charged toner is carried onto the surface of the developing roller 38, and enters between the developing roller 38 and the pressing portion 72 of the regulating blade 39, as the developing roller 38 rotates. At the time when the toner enters between the developing roller 38 and the pressing portion 72, the toner is further charged and carried on the surface of the developing roller 38 as a thin layer whose thickness has been regulated.

The drum cartridge 33 includes a frame 81, a photosensitive drum 82 disposed in the frame 81, a scorotron charger 83, a transfer roller 84, and a cleaning unit 85.

A rear portion of the frame 81 is formed as a drum accommodating portion 86 that accommodates the photosensitive drum 82, the scorotron charger 83, the transfer roller 84, and the cleaning unit 85. A front portion of the frame 81 is open upwardly and formed as a developer accommodating portion 87 that accommodates the developing cartridge 34.

The photosensitive drum 82 is disposed parallel to a width direction of the frame 81, and rotatably supported at each end of the frame 81 in the width direction of the frame 81. The photosensitive drum 82 includes an aluminum cylindrical drum that is electrically grounded, and a positively chargeable photosensitive coating layer that is made from polycarbonate and formed on the surface of the aluminum cylindrical drum.

The scorotron charger 83 is disposed parallel to the width direction of the frame 81, above the photosensitive drum 82 with a predetermined distance between the photosensitive drum 82 and the scorotron charger 83, to prevent the charger 83 from contacting the photosensitive drum 82. The charger 83 is a positively charging scorotron charger that generates corona discharge from a tungsten wire. The charger 83 uniformly and positively charges the surface of the photosensitive drum 82.

The surface of the photosensitive drum 82 is uniformly and positively charged by the scorotron charger 83 while the photosensitive drum 82 is rotating. As the surface of the photosensitive drum 82 is selectively exposed to the laser beam emitted from the scanner unit 20 based on image data, an electrostatic latent image is formed on the surface of the photosensitive drum 28.

In accordance with the rotation of the developing roller 38, the toner which is carried on the developing roller 38 and is positively charged, contacts the photosensitive drum 82 and is supplied to the electrostatic latent image formed on the photosensitive drum 82.

The transfer roller 84 is disposed parallel to the width direction of the frame 81, below the photosensitive drum 82 to face the photosensitive drum 82. The transfer roller 84 is rotatably supported at each end of the frame 81 in the width direction of the frame 81. The transfer roller 84 includes a metal roller shaft covered by a roller portion formed of conductive rubber. The roller shaft is connected to a power source (not shown). A transfer bias is applied to the roller shaft of the transfer roller 84 to transfer the toner onto the sheet 3.

While making contact with the surface of the photosensitive drum 82, the sheet 3 fed by the register rollers 11 passes between the photosensitive drum 82 and the transfer roller 84, and the toner carried on the surface of the photosensitive drum 82 is transferred on the sheet 3 in accordance with the rotation of the photosensitive drum 82. The sheet 3 having the toner transferred thereon is fed to the fixing unit 22.

The cleaning unit 85 is disposed in a rear portion of the drum accommodating portion 86, opposite to the developing roller 38 with respect to the photosensitive drum 82. The cleaning unit 85 includes a first cleaning roller 88, a second cleaning roller 89, a scraping sponge 90, and a paper powder reservoir 91.

The first cleaning roller 88 is disposed parallel to the width direction of the frame 81 to face the photosensitive drum 82. The first cleaning roller 88 is rotatably supported at each end of the frame 81 in the width direction of the frame 81. A cleaning bias is applied to the first cleaning roller 88 to remove the toner remaining on the photosensitive drum 82.

The second cleaning roller 89 is disposed parallel to the width direction of the frame 81 to face the first cleaning roller 88. The second cleaning roller 89 is rotatably supported at each end of the frame 81 in the width direction of the frame 81.

The scraping sponge 90 is disposed parallel to the width direction of the frame 81 above the second cleaning roller 89, to contact the second cleaning roller 89. The scraping sponge 90 is rotatably supported at each end of the frame 81 in the width direction of the frame 81.

The paper powder reservoir 91 is formed as a space in the drum accommodating portion 86 behind the first cleaning roller 88.

A relatively low bias is applied to the first cleaning roller 88 when the toner is transferred from the photosensitive drum 82 to the sheet 3, to temporarily catch the toner remaining on the photosensitive drum 82 by the first cleaning roller 88.

A relatively high bias is applied to the first cleaning roller 88 when the toner is not transferred from the photosensitive drum 82 to the sheet 3, that is, when a part of the photosensitive drum 82 corresponding to an interval between two successive sheets 3 contacts the first cleaning roller 88. Accordingly, the toner temporarily caught by the first cleaning roller 88 is returned to the photosensitive drum 82, and paper powders attached by the sheet 3 to the photosensitive drum 82 are caught by the first cleaning roller 88. The toner returned to the photosensitive drum 82 is collected by the developing roller 38.

As the first cleaning roller 88 is brought into confrontation with the second cleaning roller 89, the paper powders caught by the first cleaning roller 88 is caught by the second cleaning roller 89. As the second cleaning roller 89 is brought into confrontation with the scraping sponge 90, the paper powders caught by the second cleaning roller 89 is scraped by the scraping sponge 90 and stored in the paper powder reservoir 91.

The fixing unit 22 is positioned downstream of the process unit 21 in the sheet feeding direction behind the process unit 21. The fixing unit 22 includes a heat roller 92, a pressure roller 93 and feed rollers 94. The heat roller 92 includes a metal tube accommodating a halogen lamp as a heat source. The pressure roller 93 is disposed below the heat roller 92 to press the heat roller 92 from below. The feed rollers 94 are disposed downstream of the heat roller 92 and the pressure roller 93 in the sheet feeding direction.

The toner image transferred onto the sheet 3 is thermally fixed to the sheet 3 while the sheet 3 passes through between the heat roller 92 and the pressure roller 93. The sheet 3 is guided by the feed rollers 94 to a guide plate 95 vertically disposed behind the feed rollers 94. Then, the sheet 3 is fed toward discharge rollers 96 and discharged onto a discharge tray 97.

The shaft 48 of the agitator 36 is supported at the deepest portion 68 of the recessed groove 65 in the developing cartridge 34, while the vertical movement of the shaft 48 is restricted by the restricting portion 66 integrally formed with the recessed groove 65, as shown in FIG. 20. In other words, the shaft 48 of the agitator 36 is supported in a space defined by the deepest portion 68 of the recessed groove 65 and the restricting portion 66 integrally formed with the recessed groove 65. Therefore, the shaft 48 of the agitator 36 is fixedly disposed in the recessed groove 65 while the vertical movement of the shaft 48 is accurately restricted. Consequently, looseness is reduced for the shaft 48 of the agitator 36, to maintain the proper rotation of the agitator 36.

The deepest portion 68 is formed into a substantially rectangular shape. If the deepest portion 68 is formed into a substantially round shape, the shaft 48 and the deepest portion 68 contact each other at a plane. Such structure will cause the improper rotation of the agitator 36 as the toner enters between the deepest portion 68 and the shaft 48 and is clogged. If the deepest portion 68 is formed into a substantially rectangular shape like the embodiment, the shaft 48 and the deepest portion 68 contact each other at a point. Therefore, the toner clogging at the contact portion between the shaft 48 and the deepest portion 68 does not readily occur, so that the smooth rotation of the agitator 36 is ensured.

The guide portion 67 of the recessed groove 65 is of a substantially inverted trapezoidal shape in side view, with the upper end of the guide portion 67 open and the width of the guide portion 67 getting gradually narrower from its upper end toward its lower end. Therefore, as the shaft 48 is inserted from the upper portion of the guide portion 67 toward the lower portion, the shaft 48 can be guided toward the deepest portion 68 along the shape of the guide portion 67. Thus, ease of the assembly of the shaft 48 to the deepest portion 68 is improved.

The restricting portion 66 is formed above the deepest portion 66 between the guide portion 67 and the deepest portion 68 to continuously extend from the rear end of the recessed groove 65 toward the front end thereof. With the restricting portion 66 disposed above the shaft 48 of the agitator 48 supported at the deepest portion 68, the vertical movement of the shaft 48 is restricted. Accordingly, the shaft 48 of the agitator 36 is properly supported at the deepest portion 68.

The space S is formed in the guide portion 67 by the restricting portion 66. The shaft 48 of the agitator 36 is inserted into the deepest portion 68, through the space S. Accordingly, ease of the assembly of the shaft 48 to the deepest portion 68 is improved.

The width of the space S is smaller than the diameter of the shaft 48 of the agitator 36. Accordingly, the shaft 48 of the agitator 36 supported at the deepest portion 68 does not readily come out of the restricting portion 66.

Figure 24:
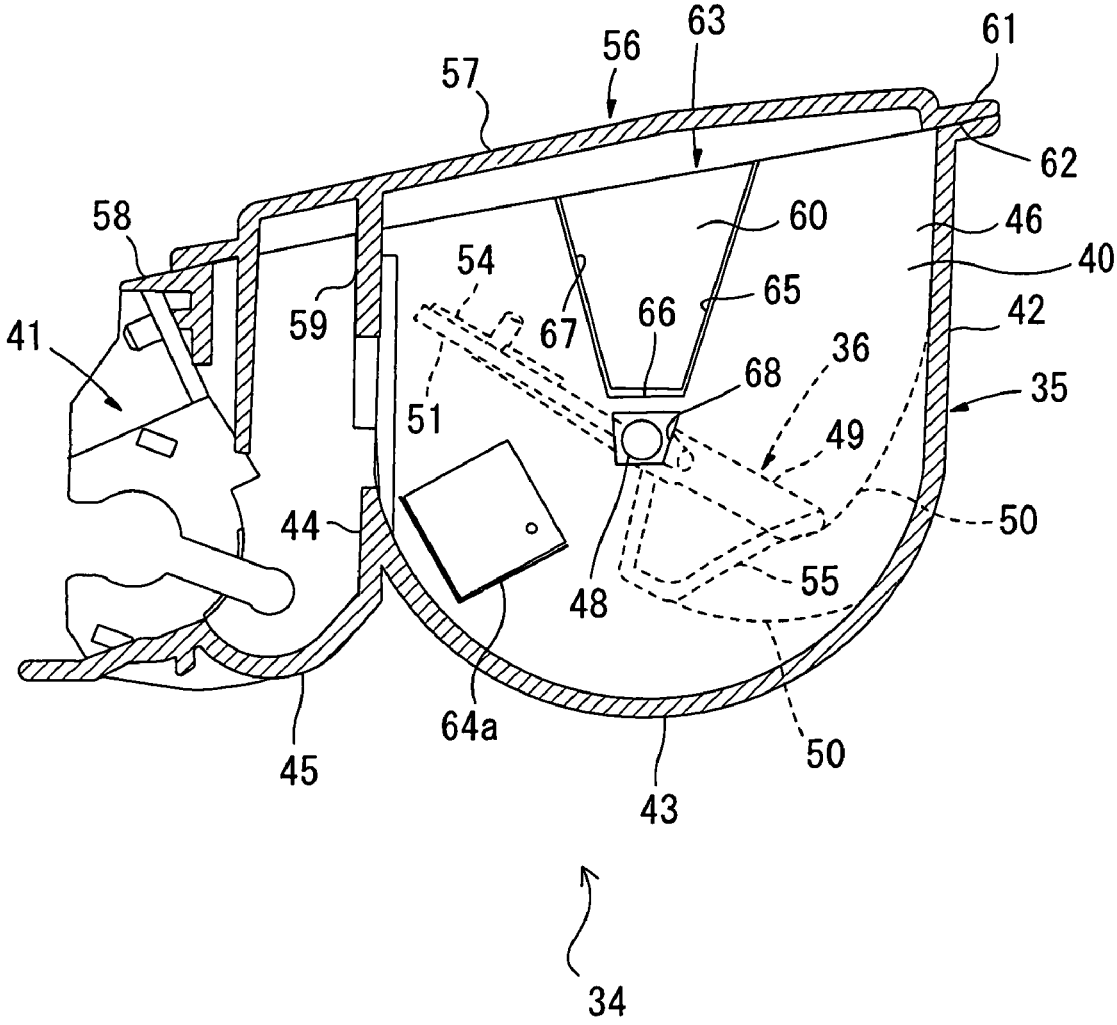
FIG. 24 is a side sectional view of a developing cartridge according to a modification of an embodiment shown in FIG. 19.
Figure 25:
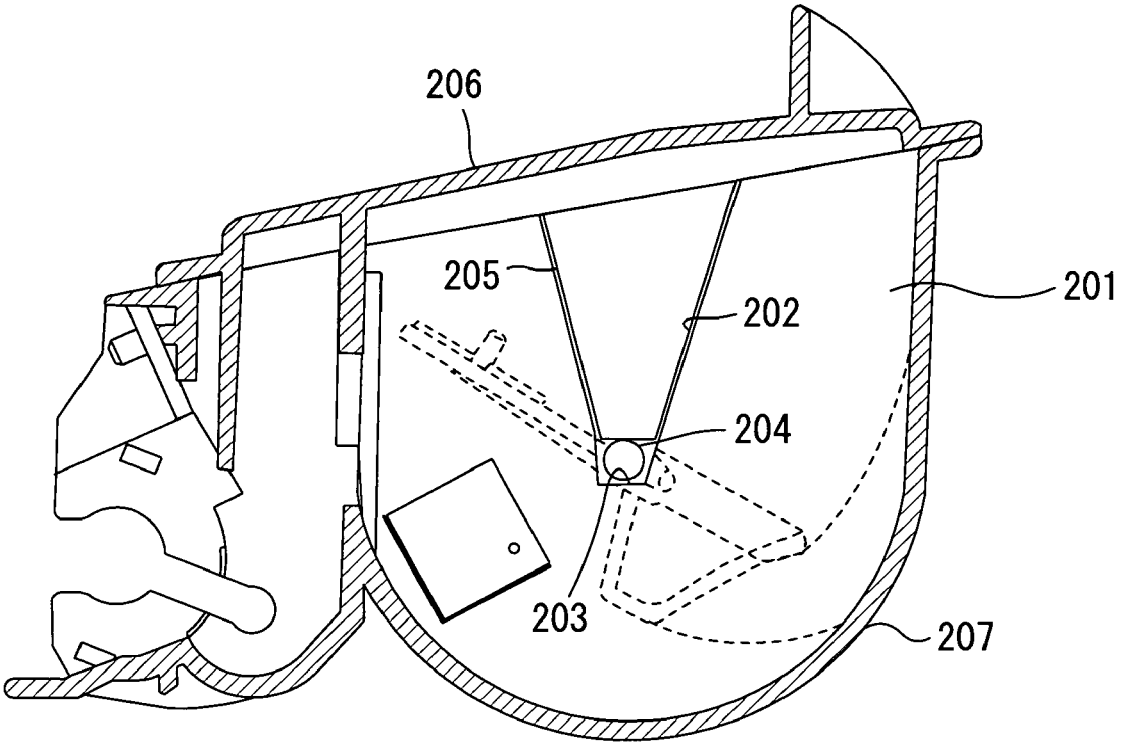
FIG.25 RELATED ART
FIG. 25 is a side sectional view of a conventional cartridge.

As shown in FIG. 24, the restricting portion 66 may be formed to connect the rear end to the front end of the recessed groove 65. Accordingly, the shaft 48 of the agitator 36 supported at the deepest portion 68 is prevented from coming out of the restricting portion 66.

The diameter of the shaft 48 of the agitator 36 is set to a size of about 3–8 mm so that is easy to flex the shaft 48. Accordingly, the shaft 48 is supported at the deepest portion 68 by readily flexing the shaft 48. As described above, when the agitator 36 is set in the toner containing chamber 40, the end 48*b* is first inserted into the through hole 70 formed on the side wall 47. Thereafter, the shaft 48 of the agitator 36 is flexed in an axial direction thereof by its own elasticity. The end 48*a* of the shaft 48 is inserted into the guide portion 67 of the recessed groove 65 from its upper end to its lower end. The end 48*a* made contact with the restricting portion 66 is pushed down to the deepest portion 68, through the space S. Thus, ease of the assembly of the shaft 48 to the deepest portion 68 is improved. In addition, the shaft 48 is fixedly supported at the deepest portion 68.

The end 48*b* of the shaft 48 of the agitator 36 is inserted into the through hole 70 and the end 48*a* is supported at the deepest portion 68. Therefore, the shaft 48 of the agitator 36 is supported without looseness or rattle.

The residual toner amount detecting windows 64*a*, 64*b* are provided on the side walls 46, 47 of the toner containing chamber 40, respectively, such that the windows 64*a*, 64*b* are flush with inner surfaces of the side walls 46, 47. As the engaging plate 60 of the upper cover 56 engages with the guide portion 67 of the recessed groove 65 formed on the side wall 46, the engaging plate 60 is flush with the inner surface of the side wall 46.

Accordingly, the distance between each end of the wing member 49 in the axial direction thereof and the inner surface of the side wall 46, 47 in the axial direction of the agitator 36 is set substantially equally. By setting the distance between each end of the wing member 49 in the axial direction thereof and the inner surface of the side wall 46, 47 including the residual toner amount detecting window 64*a*, 64*b* and the engaging plate 60, to a small amount, the amount of toner is reduced that enters in the space between each end of the wing member 49 in the axial direction thereof and the inner surface of the side wall 46, 47. Accordingly, toner agitating efficiency can be improved.

The wing member 49 of the agitator 36 is disposed across the agitator 36 in the axial direction thereof in the toner containing chamber 40. Therefore, the toner is sufficiently agitated across the agitator 36 in the axial direction thereof in the toner containing chamber 40.

The engaging plate 60 engages with the guide portion 67 of the recessed groove 65, so that the toner is prevented from building up in the guide portion 67.

The agitator drive gear 80 that transmits the drive force for rotating the agitator 36 is mounted on the shaft 48*b* of the agitator 36 inserted into the through hole 70. By the drive force transmitted to the agitator drive gear 80, the agitator 36 is rotated at a constant speed.

While the embodiments of the invention are described in detail, those skilled in the art will recognize that there are many possible modifications and variations which may be made in the embodiments.

What is claimed is:

1. A cartridge, comprising:

a case that accommodates a consumable therein;

a land area that protrudes from a surface of the case; and a recess that is formed on a reverse side of the surface at a position corresponding to the land area, a reverse side of a deepest portion of the recess being the land area, wherein the deepest portion of the recess is toward the land area with respect to the surface.

2. The cartridge according to claim 1, wherein the surface is formed with a plurality of threads, and the land area is above a plane defined by crests of the threads.

3. The cartridge according to claim 2, wherein the surface is a plane defined by a deepest portion of a groove formed by the threads.

4. The cartridge according to claim 2, wherein the crests of the threads extends toward the land area, with respect to the deepest portion of the recess.

5. The cartridge according to claim 1, wherein the case includes a box-shaped housing that has an open plane, and a top that covers the open plane.

6. The cartridge according to claim 5, wherein the land area, the recess, and the threads are formed on the top.

7. The cartridge according to claim 6, wherein the top is formed into a substantially rectangular shape, and the threads have a mountain shape in cross section and extend in a longitudinal direction of the top.

8. The cartridge according to claim 7, wherein the land area is formed at a substantially central portion of the top.

9. The cartridge according to claim 1, wherein a contour of the land area-and a contour of the recess are similar to each other.

10. The cartridge according to claim 9, wherein the contour of the recess is smaller than the contour of the land area.

11. The cartridge according to claim 1, wherein the case is formed of synthetic resin.

12. The cartridge according to claim 1, wherein the consumable is toner for use in an electrophotographic process, and the case is provided therein with an agitator that agitates the toner.

13. The cartridge according to claim 12, wherein the cartridge includes a carrying member that carries the toner on a surface thereof and is supported in the case.

14. A method for filling a consumable into a cartridge including a case that accommodates a consumable therein, a land area that protrudes from a surface of the case, and a recess that is formed on a reverse side of the surface at a position corresponding to the land area, a reverse side of a deepest portion of the recess being the land area, and the deepest portion of the recess being toward the land area with respect to the predetermined surface, comprising:

forming a port at a position corresponding to the recess by cutting off the land area;

filling the consumable through the port; and covering the port with a label member.

15. The method according claim 14, wherein the predetermined surface is formed with a plurality of threads, the land area is above a plane defined by crests of the threads, and when the land area is cut off, the threads formed near the land area are cut off to a deepest portion of a groove formed by the threads, to form a flat area to which the label member is attached.

16. A cartridge, comprising:

a case that accommodates a consumable therein;

a port that is formed on a surface of the case;

a flat area that protrudes from the surface of the case and is formed around the port, wherein a recess is formed at an area corresponding to a reverse side of the flat area; and a label member attached to the flat area to cover the port.

17. The cartridge according to claim 16, wherein the cartridge includes a plurality of threads formed around the flat area.

18. The cartridge according to claim 17, wherein the case includes a box-shaped housing that has an open plane, and a top that covers the open plane.

19. The cartridge according to claim 18, wherein the port, the flat area, and the threads are formed on the top.

20. The cartridge according to claim 19, wherein the top is formed into a substantially rectangular shape and the threads extend in a longitudinal direction of the top.

21. The cartridge according to claim 16, wherein the case is formed of synthetic resin.

22. The cartridge according to claim 16, wherein the consumable is toner for use in an electrophotographic process, and the case is provided therein with an agitator that agitates the toner.

23. The cartridge according to claim 22, wherein the cartridge includes a carrying member that carries the toner on a surface thereof and is supported in the case.

* * * * *